US010577234B2

(12) United States Patent
Jangbarwala et al.

(10) Patent No.: US 10,577,234 B2
(45) **Date of Patent: *Mar. 3, 2020**

(54) SYSTEM FOR MIXING AND DISPENSING BEVERAGES

(71) Applicant: SOMABAR, INC., Los Angeles, CA (US)

(72) Inventors: Ammar Jangbarwala, Los Angeles, CA (US); Dylan Purcell-Lowe, Los Angeles, CA (US)

(73) Assignee: Somabar, Inc., Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/908,639

(22) Filed: Feb. 28, 2018

(65) Prior Publication Data

US 2018/0186620 A1 Jul. 5, 2018

Related U.S. Application Data

(62) Division of application No. 14/817,864, filed on Aug. 4, 2015.

(60) Provisional application No. 62/155,187, filed on Apr. 30, 2015, provisional application No. 62/082,430, filed on Nov. 20, 2014, provisional application No. 62/033,219, filed on Aug. 5, 2014.

(51) Int. Cl.

| | |
|---|---|
| ***B67D 1/00*** | (2006.01) |
| ***B67D 1/07*** | (2006.01) |
| ***B67D 1/16*** | (2006.01) |
| ***B67D 1/12*** | (2006.01) |
| *B67D 1/08* | (2006.01) |

(52) U.S. Cl.

CPC ..... *B67D 1/0041* (2013.01); *B67D 1/0021* (2013.01); *B67D 1/0031* (2013.01); *B67D 1/0049* (2013.01); *B67D 1/0078* (2013.01); *B67D 1/07* (2013.01); *B67D 1/124* (2013.01); *B67D 1/16* (2013.01); *B67D 1/0888* (2013.01); *B67D 2001/009* (2013.01); *B67D 2210/00031* (2013.01); *B67D 2210/00083* (2013.01)

(58) Field of Classification Search

CPC .. B67D 1/0041; B67D 1/0021; B67D 1/0034; B67D 1/0078; B67D 1/07; B67D 2001/009

See application file for complete search history.

(56) References Cited

U.S. PATENT DOCUMENTS

| | | | | |
|---|---|---|---|---|
| 2011/0017776 | A1* | 1/2011 | Metropulos | B67D 1/0041 222/129.1 |
| 2011/0181417 | A1* | 7/2011 | Haskayne | B67D 1/0021 340/572.1 |
| 2012/0231126 | A1* | 9/2012 | Lo Faro | A47J 31/407 426/115 |

(Continued)

*Primary Examiner* — Timothy L Maust
*Assistant Examiner* — Timothy P. Kelly
(74) *Attorney, Agent, or Firm* — Stradling Yocca Carlson & Rauth

(57) ABSTRACT

A drink vending apparatus comprises a housing, one or more ingredient cartridges removably coupled to the housing, a mixing container, a dispensing nozzle, and a control unit. A user provides user commands from a smart device to the control unit that comprises drink requests from the user. In response thereto, ingredients are dispensed from one or more of the ingredient cartridges into the mixing container, and the mixed ingredients are dispensed from the mixing container into a receptacle.

20 Claims, 27 Drawing Sheets

(56) References Cited

U.S. PATENT DOCUMENTS

| | | | | |
|---|---|---|---|---|
| 2014/0166053 | A1* | 6/2014 | Carson | B67D 1/07<br>134/22.11 |
| 2015/0122130 | A1* | 5/2015 | Wunder | C12G 3/04<br>99/277 |
| 2016/0039653 | A1* | 2/2016 | Jangbarwala | B67D 1/0041<br>222/1 |

* cited by examiner

SYSTEM FOR MIXING AND DISPENSING BEVERAGES

The present application is a divisional of co-pending U.S. patent application Ser. No. 14/817,864, filed Aug. 4, 2015, inventors Ammar Jangbarwala et al., entitled "System for Mixing and Dispensing Beverages," which claims priority based on: U.S. Provisional Patent Application Ser. No. 62/155,187, filed Apr. 30, 2015; U.S. Provisional Patent Application Ser. No. 62/082,430, filed Nov. 20, 2014; and U.S. Provisional Patent Application Ser. No. 62/033,219, filed Aug. 5, 2014, the entirety of all of which are incorporated herein by reference.

BACKGROUND OF THE INVENTION

Field of the Invention

The present invention relates to an appliance for mixing and dispensing beverages, and in particular, to a system, method and appliance for mixing and dispensing beverages that can include alcoholic and non-alcoholic beverages.

Description of the Related Art

Making cocktails requires certain skills which most people do not have. Because of this, most people drink mixed cocktails at a bar or restaurant or make simple cocktails that require two or more ingredients like whiskey and soda. Others attempt to mix these ingredients manually on their own, but they often are not able mix the drinks using the correct amounts or proportions of the ingredients.

To address this need, appliances like vending or dispensing machines have been provided where the separate ingredients are dispensed into a glass, cup or other drinking container. Unfortunately, these conventional vending machines suffer from several drawbacks.

First, these ingredients are not mixed prior to dispensing, so the consumer would often have to mix the ingredients, and the taste quality of the resulting drink may not be as high as a comparable drink that has been mixed correctly.

Second, many of these vending machines are rather large in size, and cannot be used in homes on standard kitchen counters or in underneath standard kitchen cabinets.

Third, these vending machines usually have a built-in touch screen, and the user must order or prepare the drinks by directly controlling the touch screen at the machine itself, and not from afar.

Fourth, many of these vending machines do not provide for convenient replacement or replenishment of the ingredients.

Fifth, many of these vending machines do not provide for effective and efficient rinsing and cleaning.

Sixth, loading ingredients into these vending machines is typically cumbersome, requiring the user to ensure specific pumps are attached to specific ingredients to ensure the proper ingredient is dispensed upon receiving a drink order. Alternatively, many of these automated vending machines will require the consumer to program or manually designate the ingredients in a particular ingredient container in order to ensure the proper ingredient is dispensed upon receiving a drink order.

Thus, there remains a need to provide a vending system that overcomes the drawbacks identified above.

SUMMARY OF THE INVENTION

It is an object of the present invention to provide a vending system that collects the ingredients together as one unit, mixes and then dispenses them after they have been mixed.

It is another object of the present invention to provide a vending system which allows the user to order and control the preparation of a drink, and in some embodiments may enable the user to order and control preparation from a remote location using a phone, tablet, computer or other smart device.

It is yet another object of the present invention to provide a vending system which fits on a standard kitchen counter and underneath standard kitchen cabinets, so that the vending system can be used at home, for example, or in a hotel room, on a restaurant or bar counter, or in any other commercial venue without material impact to standard design or operational flow.

In order to accomplish the objects of the present invention, there is provided an apparatus and method for ordering and mixing a selected drink. According to the method, a drink vending apparatus is provided, the apparatus comprising a housing, one or more ingredient cartridges removably coupled to the housing, a mixing container, a dispensing nozzle, and a control unit. In addition, a user provides user commands from a smart device to the control unit that comprises drink requests from the user. In response thereto, ingredients are dispensed from one or more of the ingredient cartridges into the mixing container, and the mixed ingredients are dispensed from the mixing container into a receptacle.

It is yet another object of the present invention to provide for a vending system that is able to detect the ingredients contained within each ingredient cartridge. This may be accomplished by, for example, utilizing ingredient cartridges containing programmable radio-frequency identification ("RFID"), near-field communication ("NFC") and/or other similar identification mechanism which contains, among other things, information regarding the ingredient within the canister, which may be "read" by the vending system.

Thus, the present invention provides an apparatus that automatically mixes and dispenses multiple ingredients in a convenient size and design for universal application in order to create mixed alcoholic cocktails and/or shots, and differs from conventional drink vending apparatus in the following ways. First, the drinks are mixed before they exit the appliance. Second, the apparatus is of an appropriate size for most standard kitchens, hotel room, restaurant and bar counters, and for any other commercial venue without material impact to standard design or operational flow.

DETAILED DESCRIPTION

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

Structure of Apparatus 100 in a First Embodiment

Figure 1:
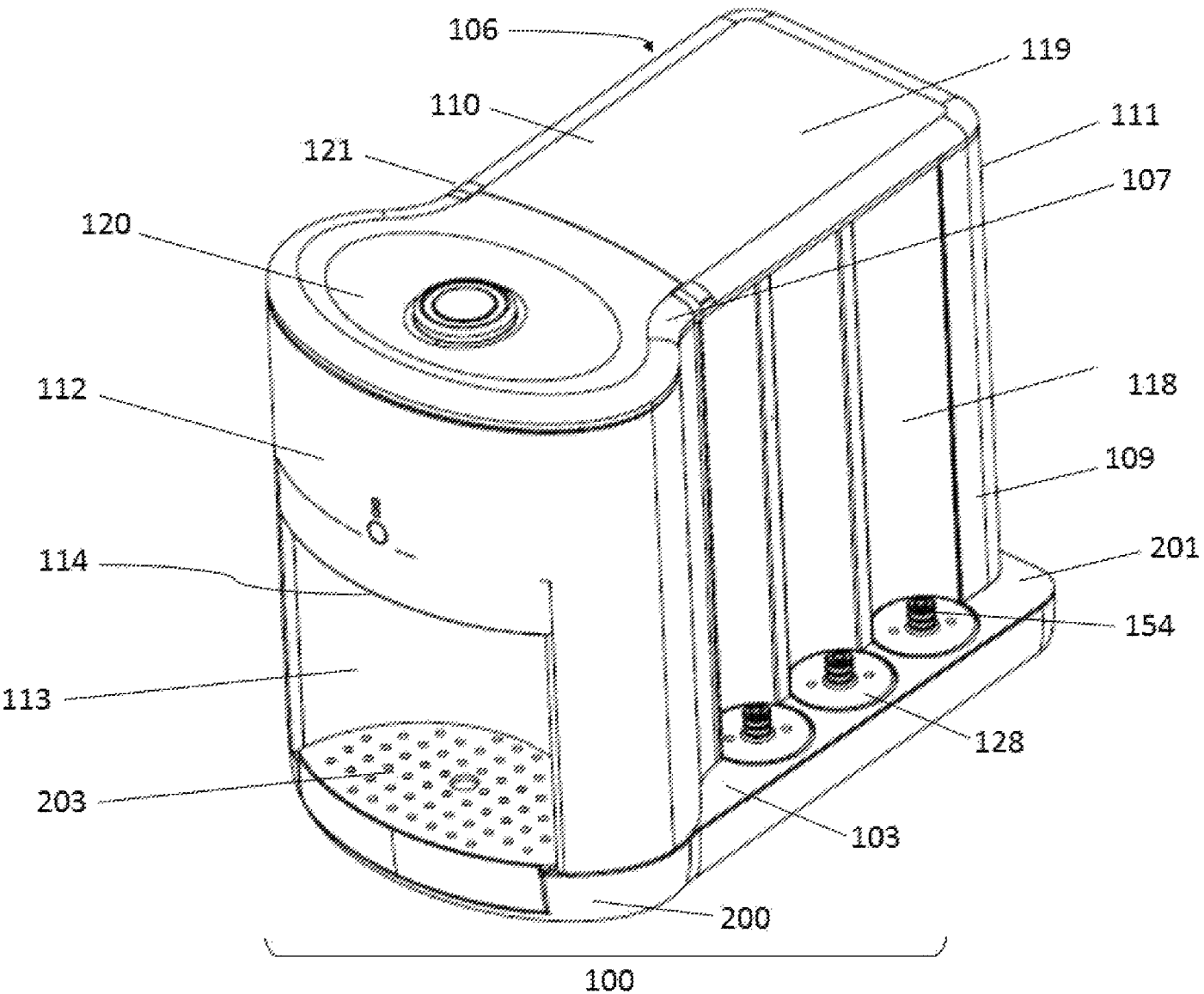
FIG. 1 is a perspective view of a vending apparatus according to one embodiment of the present invention.
Figure 2:
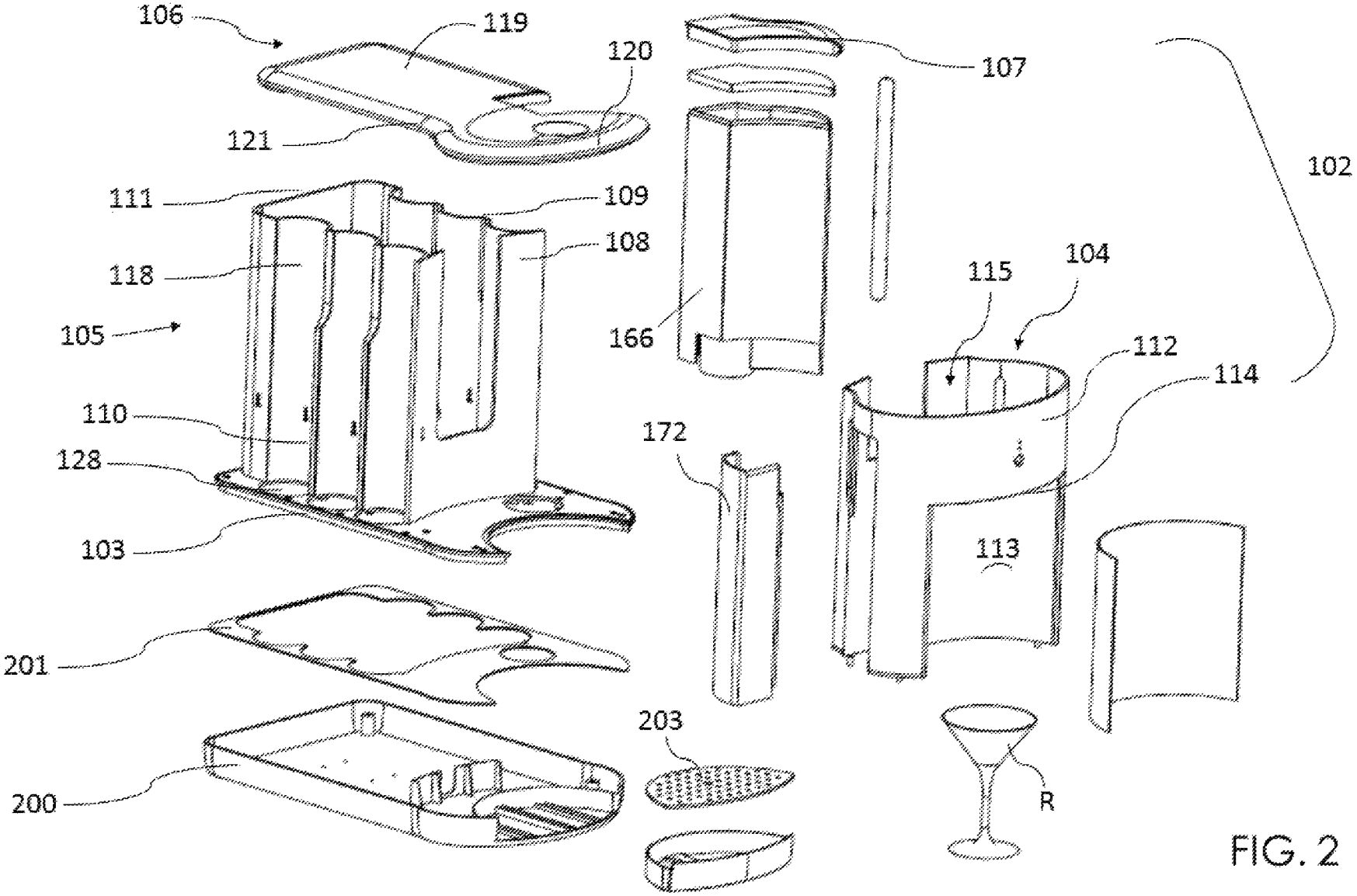
FIG. 2 is an exploded perspective view of the housing of the vending apparatus of FIG. 1.

FIGS. 1-11 illustrate a vending apparatus 100 according to a first embodiment of the present invention. The apparatus 100 is actually an appliance that is sized to be small enough to fit on a standard kitchen counter and underneath standard kitchen cabinets. Referring to FIGS. 1 and 2, the apparatus 100 has an outer housing 102 that has a base 103, a front section 104, an inner shell 105, a top cover 106, and a water container lip 107. The inner shell 105 has a front wall 108, two side walls 109 and 110, and a rear wall 111. The front section 104 has a generally cylindrical configuration that defines a generally circular inner space 115, with a rounded or curved front wall 112 having a dispensing area 113 cut out from the front wall 112, although one of ordinary skill in the art will recognize that these components can be configured in different shapes. A nozzle or spout 114 is positioned in an upper wall of the dispensing area 113 for dispensing the mixed drink into a drinking container (cup, glass, mug, etc.) that is placed in the dispensing area 113. The base 103 sits on top of a drain tray 200, with a structural layer 201 retained between the base 103 and the drain tray 200. A dispensing tray 203 is provided at the front of the base 103 and allows a receptacle R (i.e., glass, cup, mug, etc.) to be placed so as to collect the mixed drink from out of the dispensing nozzle 114. The dispensing tray 203 may also be perforated or otherwise permeable such that it also acts as a top cover for the drain tray 200 through which liquid goes through for accumulation in the drain tray 200. In alternative embodiments, the liquid can be routed from drain tray 200 to waste container 172.

In the embodiment, a main power outlet insertion 207 is provided at the rear wall 111 from which the power travels from the utility plug-in to inside the control board 162 by electrical wires. The top cover 106 has rectangular section 119 that is secured to the rear wall 111 of the inner shell 105. The top cover 106 has a circular lid section 120 that is hingedly connected to the rectangular section 119 by a hinged connection 121 so that the user is able to open the lid section 120 to access the components inside the inner space 115 of the front section 104. In this regard, a center lid 123 is provided at the center of the lid section 120 to provide a gripping area to assist the user in opening circular lid section 120 via the hinged connection 121. The water container lip 107 is extruded from the outside wall of a water container 166 to allow the user with access to take out the water container 166 from the inner space 115 for refilling and/or cleaning purposes. The water container 166 can be removed by the user to refill clean water.

Each side wall 109 and 110 has a plurality of concave sections 118. Each concave section 118 is adapted is receive an ingredient cartridge 124, which is shown in greater detail in FIG. 5 and FIG. 6. In this manner, ingredient cartridge 124 may be easily inserted and/or removed without the need to access the inner workings of the vending apparatus. Additionally, concave sections 118 may be of a different shape and accordingly, ingredient cartridge 124 and container 132 may be of a different shape as well. For example, cartridge 124 and/or container 132 and 170 may have a rounded bottom to allow efficient fluid flow.

Each cartridge 124 is adapted to hold one type of ingredient (e.g., whiskey, soda, rum, syrup), and has a lid 126 that is adapted to interact with a manifold 128 in the base 103 for allowing the liquid ingredient in that cartridge 124 to be transported to a mixing container 130. Each cartridge 124 is easily removable, reusable, dishwasher safe, and functions as a storage container.

Each cartridge 124 has a cylindrical container 132 that has an open end 134. The container 132 can be made of any material suitable for housing liquid ingredients, such as a polymer material, a food grade plastic, metal or glass material. A lid 126 is removably connected (e.g., by a screw and/or thread connection—see threads 138 at the open end 134) to the open end 134 so that the contents inside the container 132 can be changed, or new content poured inside. The lid 126 has structural mounts 136 provided inside its main circular housing to support the weight of the liquid ingredients when container 132 is full. The lid 126 comprises a sealing mechanism to prevent ingredients from leaking during storage and operation. The lid 126 further acts as housing for the following components: specifically, a gasket 140 is provided inside the lid 126 to prevent leakage of liquid contents inside the container 132 during transport or storage when the lid 126 is placed into position in the manifold 128 during storage or operation. Another gasket 142 is provided which snaps into place in a stem 148 (see below) that may be made of an elastomer material such as silicone to provide a seal in the center portion in the lid 126. Gasket 142 further prevents leakage during transport or storage. Both gaskets 140 and adjacent to and pressure fit into a gasket sleeve 144 to prevent leakage of contents from container 132 during storage or operation. The check valve 146 neutralizes negative pressure in the container 132 during the draining of the liquid content by allowing air inside, but does not allow gaseous contents to exit, thereby maintaining the integrity of carbonated and specialty ingredients. A single actuation stem 148 is positioned in the center cavity of the lid 126, and limits residue of contents in the cartridge 124 when the container 132 is disengaged from the apparatus 100 for food safety purposes. A spring 150 is positioned around the stem 148 as it provides motion to the stem inside the lid 126 for single actuation of plugging the stem 148 to eliminate liquid residue during engagement/disengagement of the cartridge 124 from apparatus 100. The spring 150 may be made of any material suitable for use in food and drink applications, such as stainless steel.

Finally, an RFID/NFC tag 152 is provided in the center cavity around the structural mounts 136 inside the lid 126, and has a silicone sleeve for a pressure fit attachment into the lid 126. As will be more fully explained below, the tag 152 stores mobile application initiated data transmitted by a controller 165 via remote antennas 158. The mobile application initiated data may also be transmitted directly between a user's smart device and the RFID/NFC tag 152.

Figure 15:
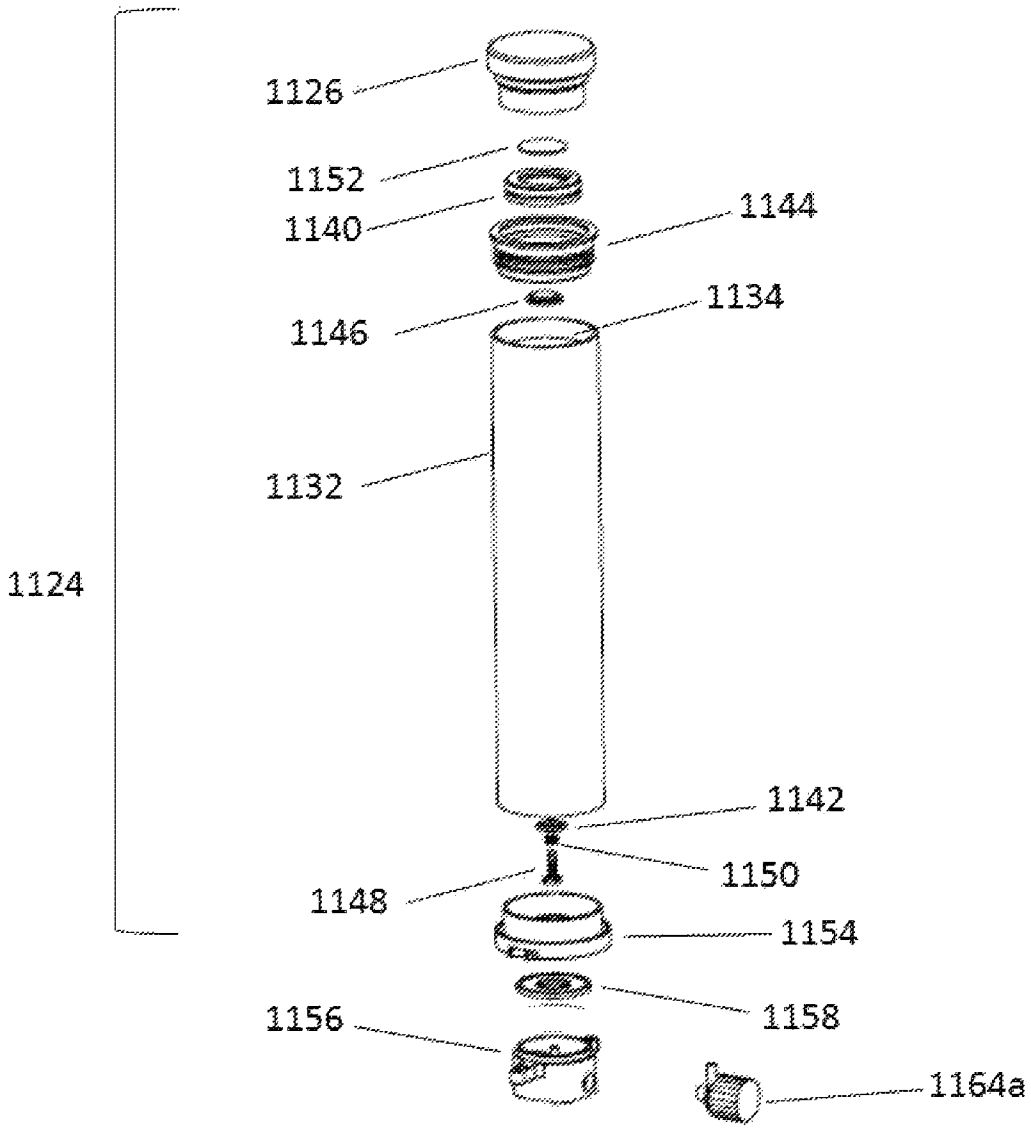
FIG. 15 is an exploded perspective view of an alternate embodiment of an ingredient cartridge for the apparatus of FIG. 1.
Figure 16:
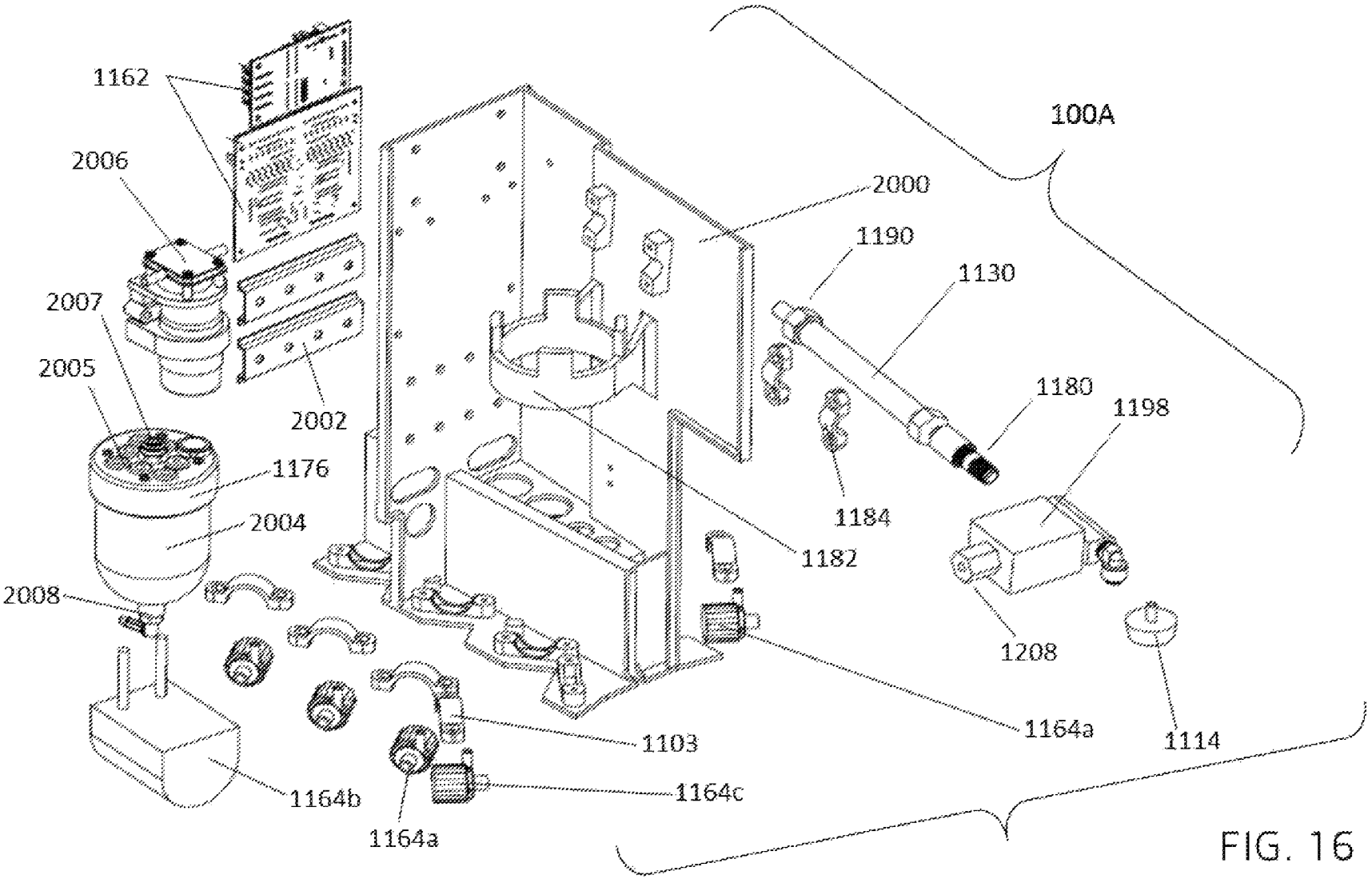
FIG. 16 is an exploded perspective view of the internal components of a vending apparatus according to a second embodiment of the present invention, shown with the housing removed.

One of ordinary skill in the art will understand that cartridge 124 may be assembled in a variety of ways. For instance, referring to FIG. 15, the lid 1126 may be placed at the end opposite of the cartridge 124 in FIGS. 5-6. In this embodiment, a valve 1146 inside the lid 1126 ensures the contents of containers 1132 remain under positive pressure. The valve 1146 restricts liquid flow (for leakage) and allows gas/vapor to permeate through. On the opposite end, a manifold top 1154 ensures a fastened surface connection to avoid liquid leakage. A gasket 1142, stem 1148 and spring 1150 are further provided with the manifold top 1154 and function in the same manner as previously discussed with respect to gasket 142, stem 148 and spring 150. Another gasket 1158 is compressed to provide a liquid tight seal and facilitate simple attachment and detachment of the cartridge containers 1132. The mechanical valve and/or fitting (i.e., the stem 148, the spring 150 and the gasket 142 as described herein) does not allow liquid to flow out of the cartridge container 1132 during transport or handling until engagement by manifold bottom 1156. The manifold bottom 1156 may or may not be attached to the outer or inner casing for ease of assembly. As shown in FIG. 15, the electronic tag 1152 may be housed within the lid 1126.

Figure 6:
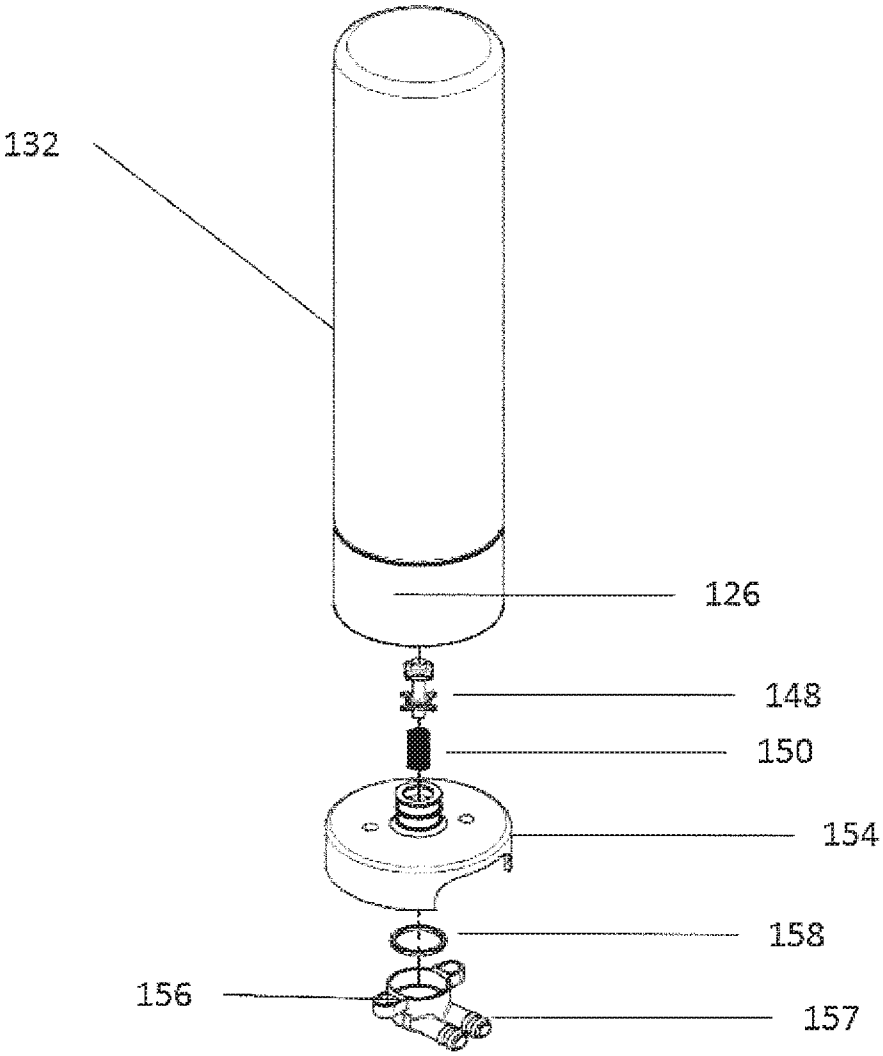
FIG. 6 is an exploded view illustrating the connection between a cartridge and a manifold.

Referring now to FIGS. 3A-3H, 5 and 6, the manifold 128 includes a manifold top 154 which is a type of connection device that is adapted to interlock the cartridge 124 to provide a leak-proof and detachable fluid-storage and/or transport mechanism. The manifold 128 also includes a manifold bottom 156, which transfers the liquid ingredients from the cartridge 124 to the pumps 164. A two-port valve 157 is provided at the manifold bottom 156 to connect wash port 159 on every manifold bottom 156 to the wash port 161 on the water manifold 167. Alternatively, tubing and/or hosing 223 is inserted into the cartridge 124 or cartridge 170 via fittings and manifold bottom 156. This tubing and/or hosing 223 is connected pumps item 164. As shown in FIG. 6, the stem 148 seals liquids inside the manifold bottom 156 when the cartridge 124 is disengaged, and the spring 150 provides actuated action of closing and opening upon the weight exerted by the stem 148. A remote RFID/NFC antenna 158 is positioned inside the manifold 128 to wirelessly interact with the RFID/NFC tag 152 embedded inside the lid 126 and a controller module 165 on a control board 162 for data storage and transmission respectively, as explained in greater detail below.

The cartridge 124 is portable and easy to use. The pouring of ingredients is done by removing the cartridge lid 126. A vacuum-breaking or relief check valve 146 ensures that the container 132 remains under positive pressure, and restricts liquid and/or gas vapor flow (for preventing leakage) outwards from cartridge 124 or manifold bottom 156, but allows gas/vapor to permeate inward into cartridge 124. The manifold top 154 ensures a fastened surface connection to avoid liquid leakage. The mechanical valve and/or fitting component therefore comprises the following parts: the stem 148, the spring 150 and the gasket 142. The mechanical valve and/or fitting component does not allow liquid or gas/vapor to flow out of the container 132 during transport or handling until engagement with the manifold bottom 156. The manifold bottom 156 may be attached to the outer or inner casing of the apparatus 100 for ease of assembly. A single headed stem 148 actuated by engagement or disengagement of cartridge 124 eliminates residue formation in or around the connection joints. All of the working mechanical components of the cartridge 124 are embedded inside the lid 126. In use, the spring 150, the stem 148, the vacuum-breaking or relief check valve 146, the RFID/NFC tag 152, and the gaskets 140 and 142 are assembled into the lid 126, after which the lid 126 is screwed onto the container 132 by the threads 138 at the open end 134 to seal the liquid contents. The liquid ingredients may be filled manually into the container 132 or may be pre-filled, with a pre-programmed RFID/NFC tag 152, and purchased by a consumer. The cartridge 124 is inserted into the manifold top 154, whereby the stem 148 is actuated or pushed vertically upwards by the manifold bottom 156 via the spring 150 so as to open the gasket 142 to allow the liquid contents to free-flow into manifold bottom 156. The port on manifold bottom 156 is connected directly to the pumps 164 which transport the liquid into the mixing container 130 via food grade channels, such as plastic tubing. The positive displacement nature of pumps 164 and vacuum-breaking or relief check valve 146 result in no back flow of liquids in the tubing and/or hosing 223 connecting manifold 128 to mixing container 130.

Referring now to FIGS. 2 and 3, there are a number of components that may be contained inside the inner space 115 of the front section 104. First, a mini cartridge 170 can be positioned adjacent one side of the inner space 115, and is similar in functionality to the other cartridges 124 but shorter in height and hence smaller in liquid capacity. Alternatively, mini cartridge 170 may be positioned outside the apparatus 100 in a manner similar to ingredient cartridges 124. The cartridge 170 is suited to hold liquid ingredients which are used in smaller amounts per drink, such as fruit bitters and syrups. Thus, ingredients stored in the smaller capacity container 170 will likely not need to be refilled more frequently than items stored in the larger container 132. The cartridge 170 has essentially the same construction as the other cartridges 124, and includes a lid 171 that can have the same construction as the lid 126, and interacts with a manifold 173 that is essentially the same as the manifold 128, except that the manifold 173 is mounted on a front component mount 175 and engages with the mini-cartridge 170 and its micro-pump 164*b* (see FIG. 3A). Thus, the cartridge 170 may be used to hold any ingredient which can be housed in cartridge 124. The front component mount 175 is positioned inside the inner space 115 of the front section 104 with screws. The front component mount 175 provides structural support for the micro-pump 164*b*, the mixing container 130 (and all associated parts), the three-port diverter valve 198, and all the other components shown in FIG. 6. Another mount 214 is positioned on front component mount 175 to provide structural support and to absorb vibration from the micro-pump 164*b*. The mount 214 is wrapped around micro-pump 164*b*.

Second, a clean water container 166 is seated within inner space 115. It is easily removable and reusable, and is used to supply water or cleaning liquid ingredients for the apparatus 100 for rinsing and/or maintenance cycles. The container 166 is taller and wider in dimension than the cartridge 124 so as to store more water or cleaning liquid. A manifold 167 (see FIG. 3B) is provided below the water container 166 and functions in the same manner as the manifold 128.

Figure 3A:
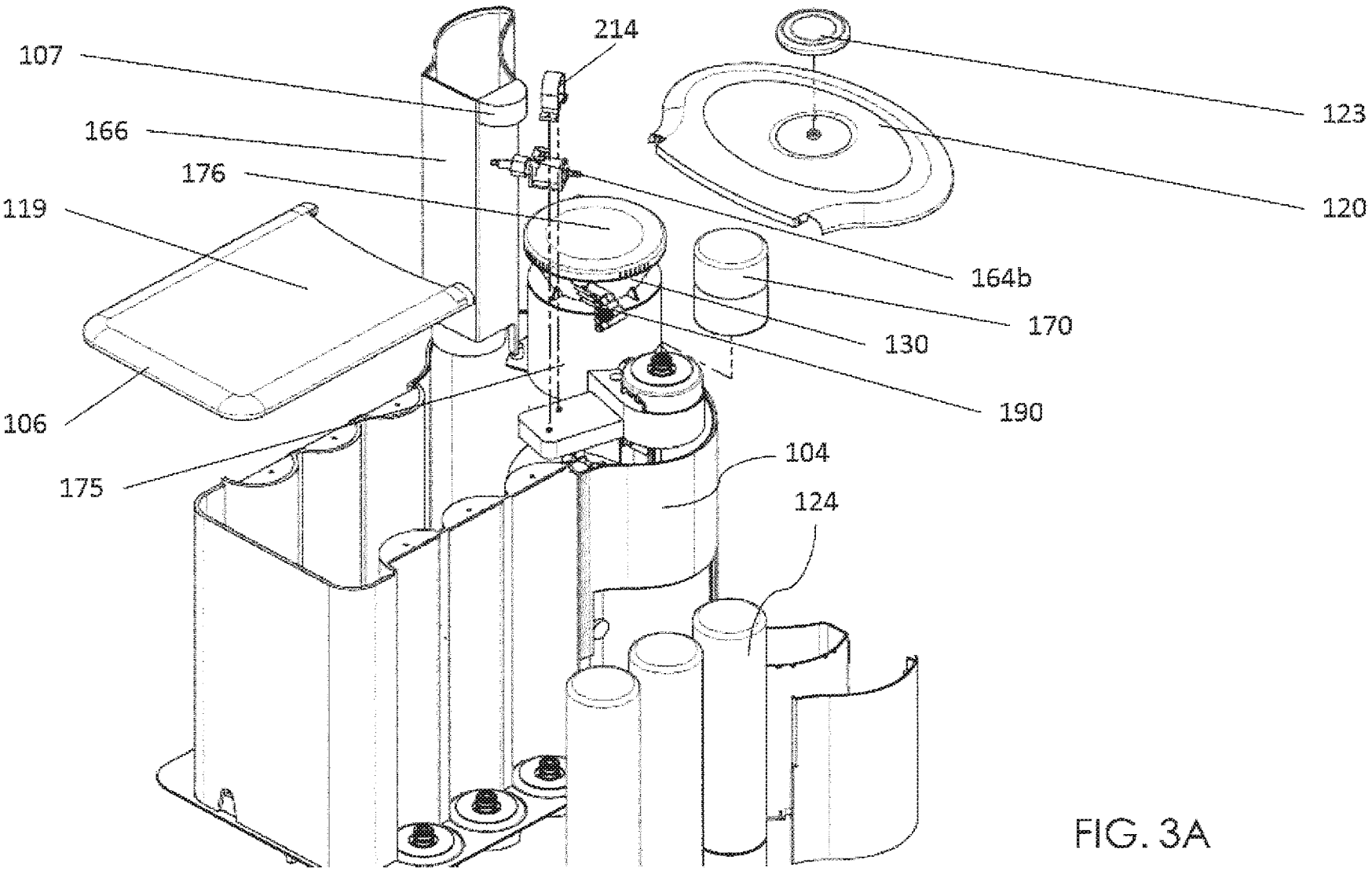
FIG. 3A is an exploded top perspective view of the internal components of the vending apparatus of FIG. 1.
Figure 3B:
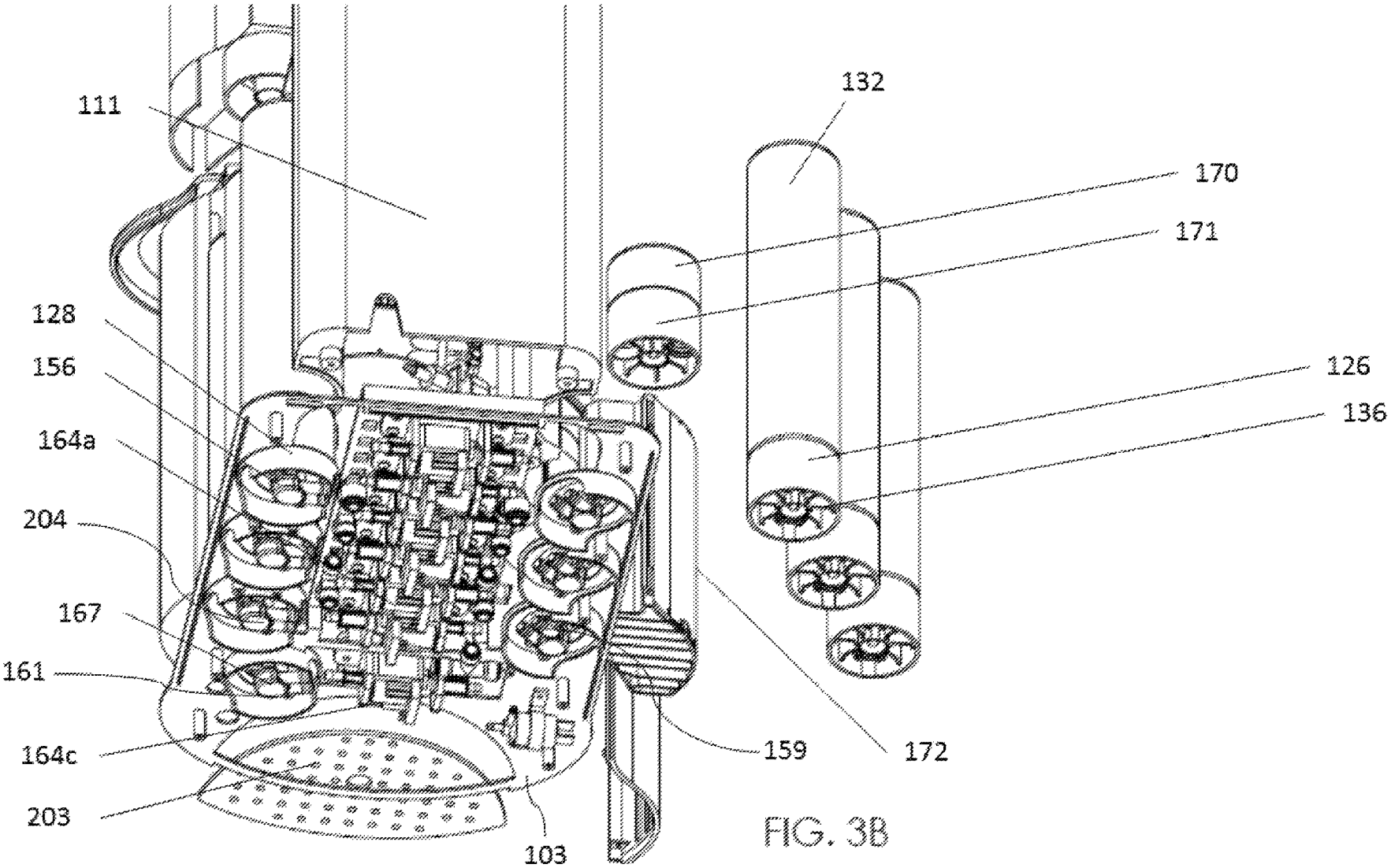
FIG. 3B is an exploded bottom perspective view of the internal components of the vending apparatus of FIG. 1.
Figure 3C:
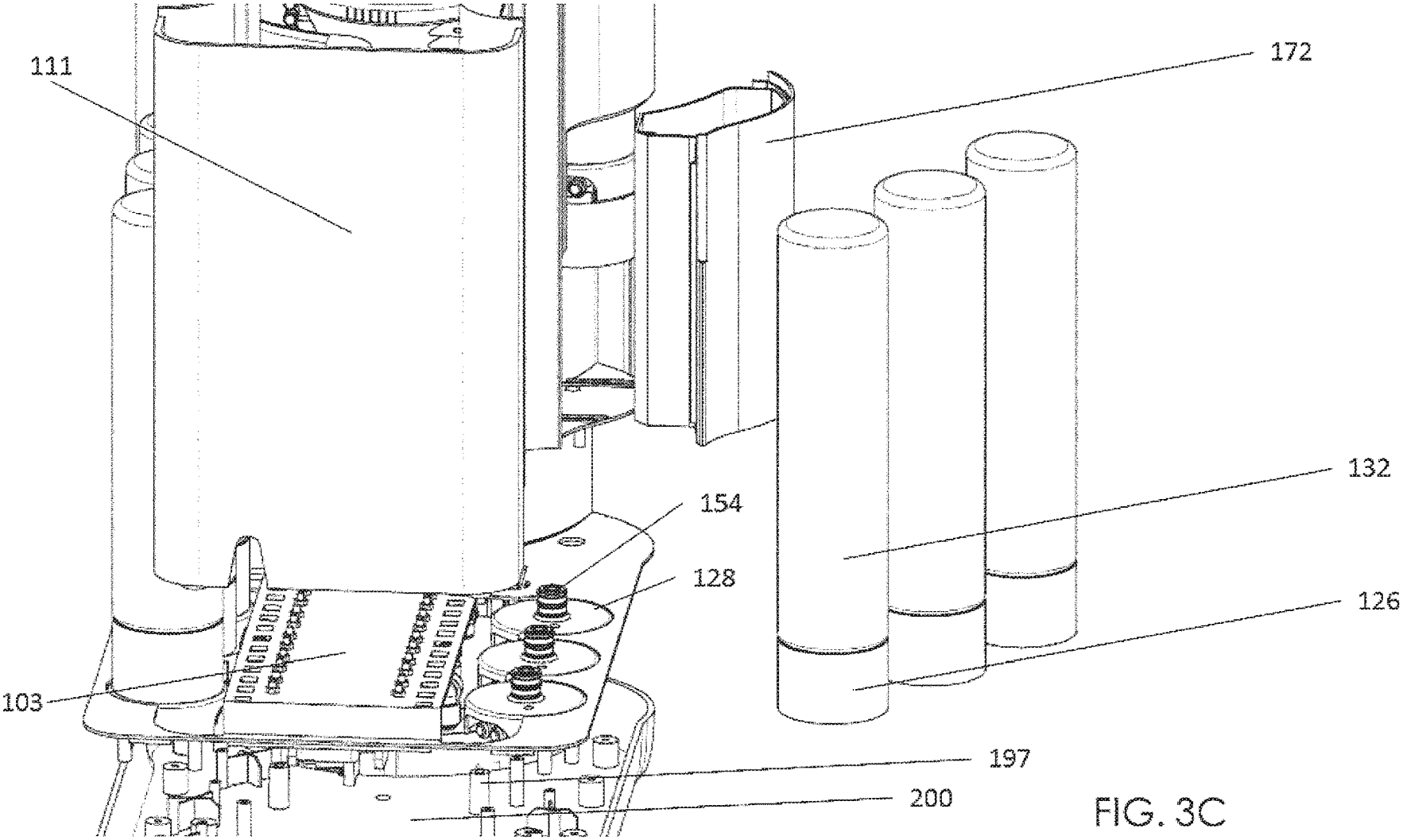
FIGS. 3C and 3D are other exploded views of the vending apparatus of FIG. 1 showing some of the components thereof.
Figure 3D:
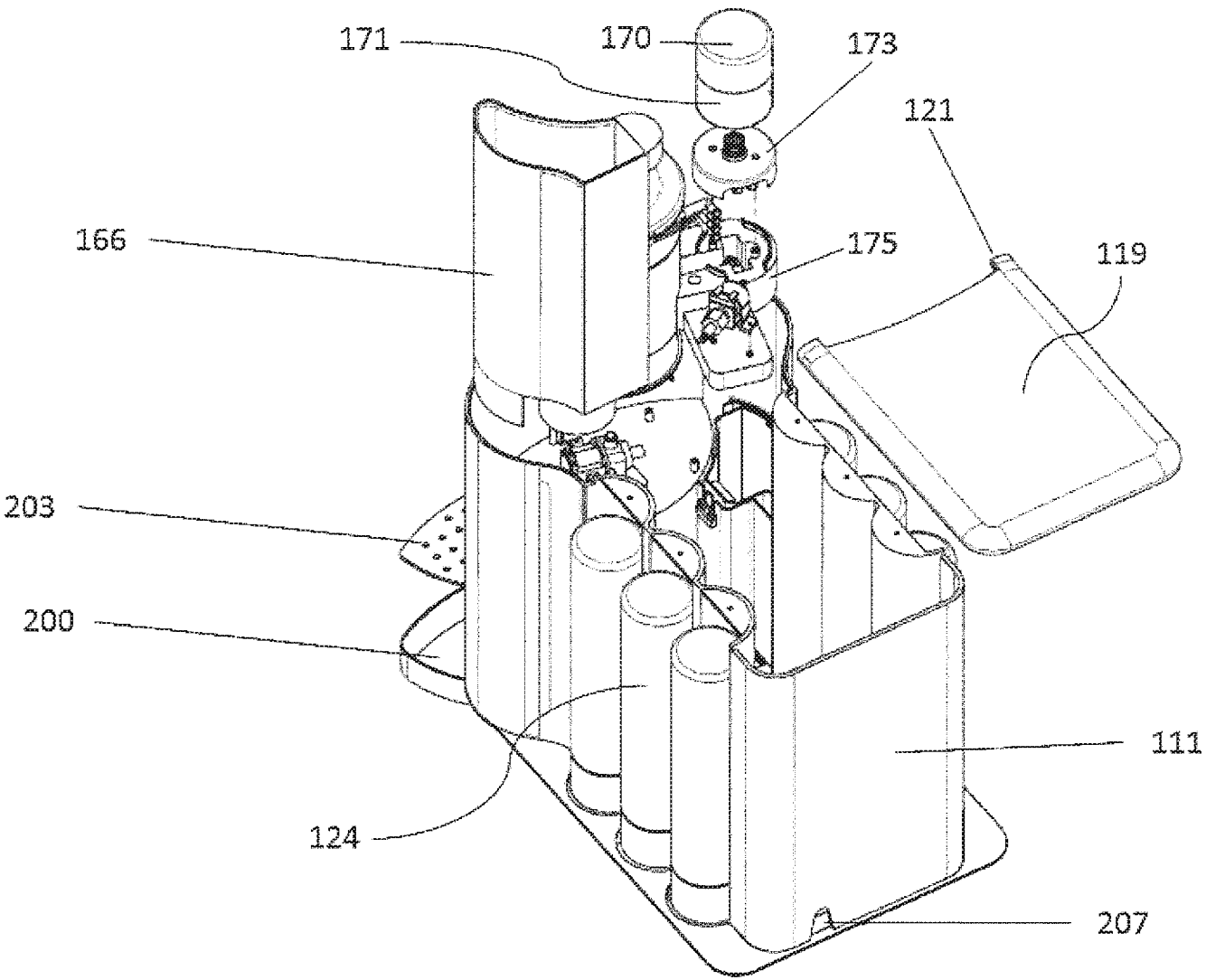
Figure 3E:
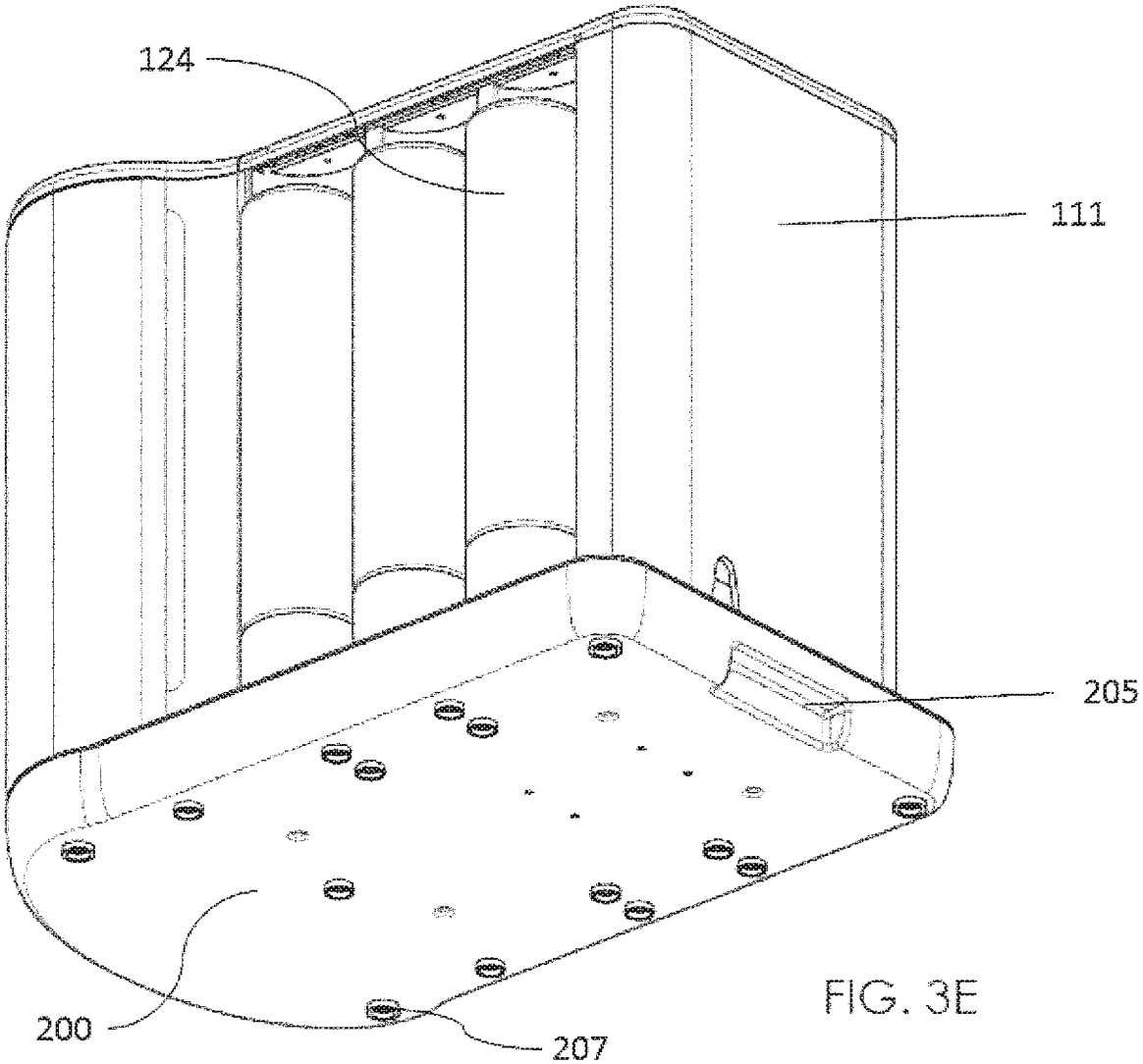
FIG. 3E is a bottom perspective view of the vending apparatus of FIG. 1.
Figure 3F:
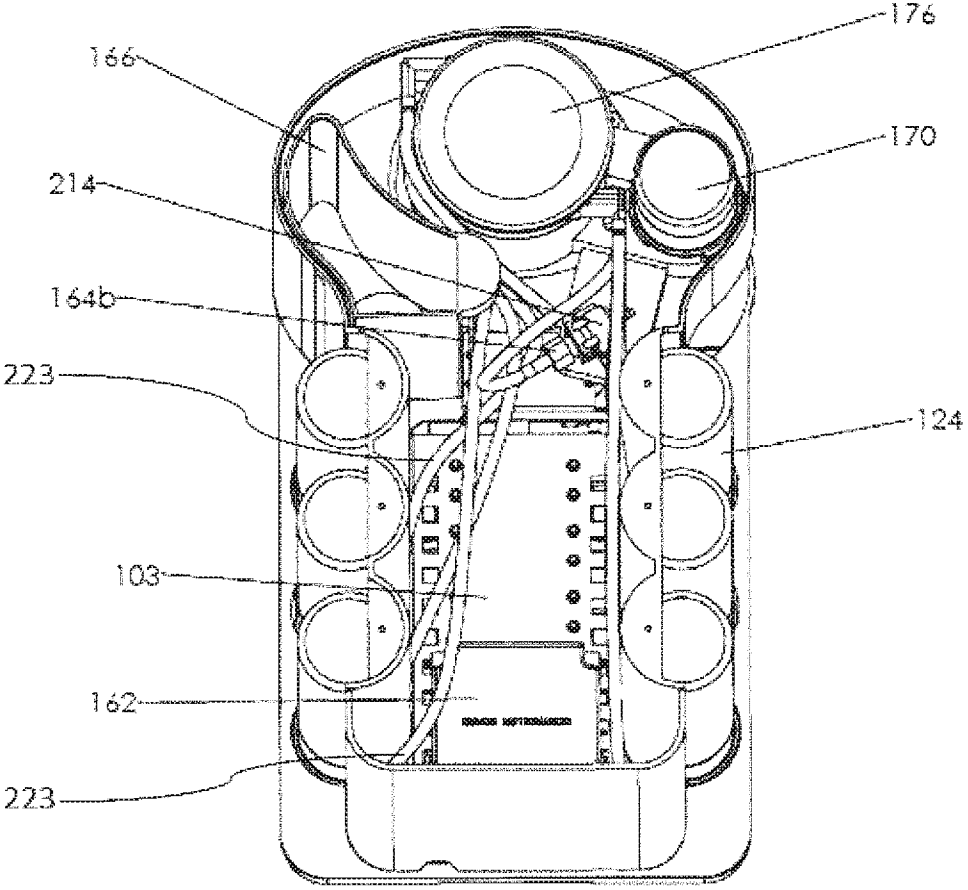
FIG. 3F is a top perspective view of the vending apparatus of FIG. 1 with the cover removed.

Third, referring to FIGS. 3B and 3C, a waste water container 172 is positioned underneath the mini-cartridge 170. It is also easily removable and reusable, and is used to collect waste water used in flushing/cleaning cycles and residue liquid contents during operation. The container 172 is preferably of a larger volume than the cartridge 124 so as to store more water or cleaning liquid.

Fourth, a mixing container 130 is positioned inside the inner space 115 and between the container 166 and the mini-cartridge 170. The mixing container 130 is a stationary container which serves a dual purpose of accumulating the total ingredients with simultaneous mixing action using cyclonic inducing turbulence, before dispensing the mixed drink or cocktail from the dispensing nozzle 114 into a drinking container. In the second embodiment described hereinbelow, static blades 2009 can be provided in the mixing container or well 1130 to provide motionless mixing, where ingredients are thoroughly mixed by being transported through or over blades, grooves, or other such obstructing object or objects 2009 that would be familiar to someone skilled in the art of motionless mixing. Referring also to FIGS. 8-11, the mixing container 130 has a generally conical shape with its largest diameter at its mouth 178 at the top, and tapering towards a narrowed outlet 180 at the bottom. A support panel 182 and supporting fins 184 are provided at the bottom of the mixing container 130 to provide structural support to mixing container 130 and all parts shown in FIG. 8. A lid 176 is provided to cover the mouth 178, and can be removed manually by user to clean the inside of the mixing container 130. A plurality of openings 192 is provided in the wall on opposite sides of the mixing container 130 for receiving the tubular lines 193 of the fitting 190. This fitting 190 is a multi-line junction fitting which connects tubing or hoses from all liquid ingredients and accumulates, by timing sequences, when the designated pumps 164 would turn on and off in cycles, extracting liquid from the cartridges 124 and delivering the liquid into the mixing container 130. Alternatively, pumps 164 may pump ingredients into a combined line (i.e., a mixing channel) which then delivers combined ingredients into mixing container 130 via a single opening in a similar fashion as described with respect to opening 192, tubular line 193 and fitting 190.

In the embodiment shown in FIGS. 8-11, each fitting 190 accommodates four separate lines 193, one for each different ingredient or liquid. Fitting 190 can be separated into four parts accommodating to each line 193. The lines 193 will introduce the ingredients/liquid at locations in the conical wall of the missing container 130 that are nearer the mouth 178, so that each ingredient/liquid that enters the mixing container 130 through the corresponding line and opening 192 will travel is a conical path as it swirls (under the force of gravity or any external source providing hydraulic or pneumatic supply pressure) towards the outlet 180 at the bottom. See FIG. 11. It is important that all the necessary ingredients/liquids for the selected drink be introduced and enter the mixing container 130 at or around the same time, so that all these ingredients/liquids are thoroughly mixed as they travel in the conical path towards the outlet 180. Thus, this design allows for effective mixing using a stationary mixing container 130.

In addition, there is a water inlet 188 that is positioned just above each set of openings 192 on the wall of the mixing container which circulates clean water during cleaning cycles to remove residue in the same manner as the ingredients/liquids travel along the conical path inside the mixing container 130 to carry away any residue. A three-port diverter valve 198 is positioned below the outlet 180 of the mixing container 130 to direct the flow between the waste water container 172 and the dispenser nozzle 114.

Figure 7:
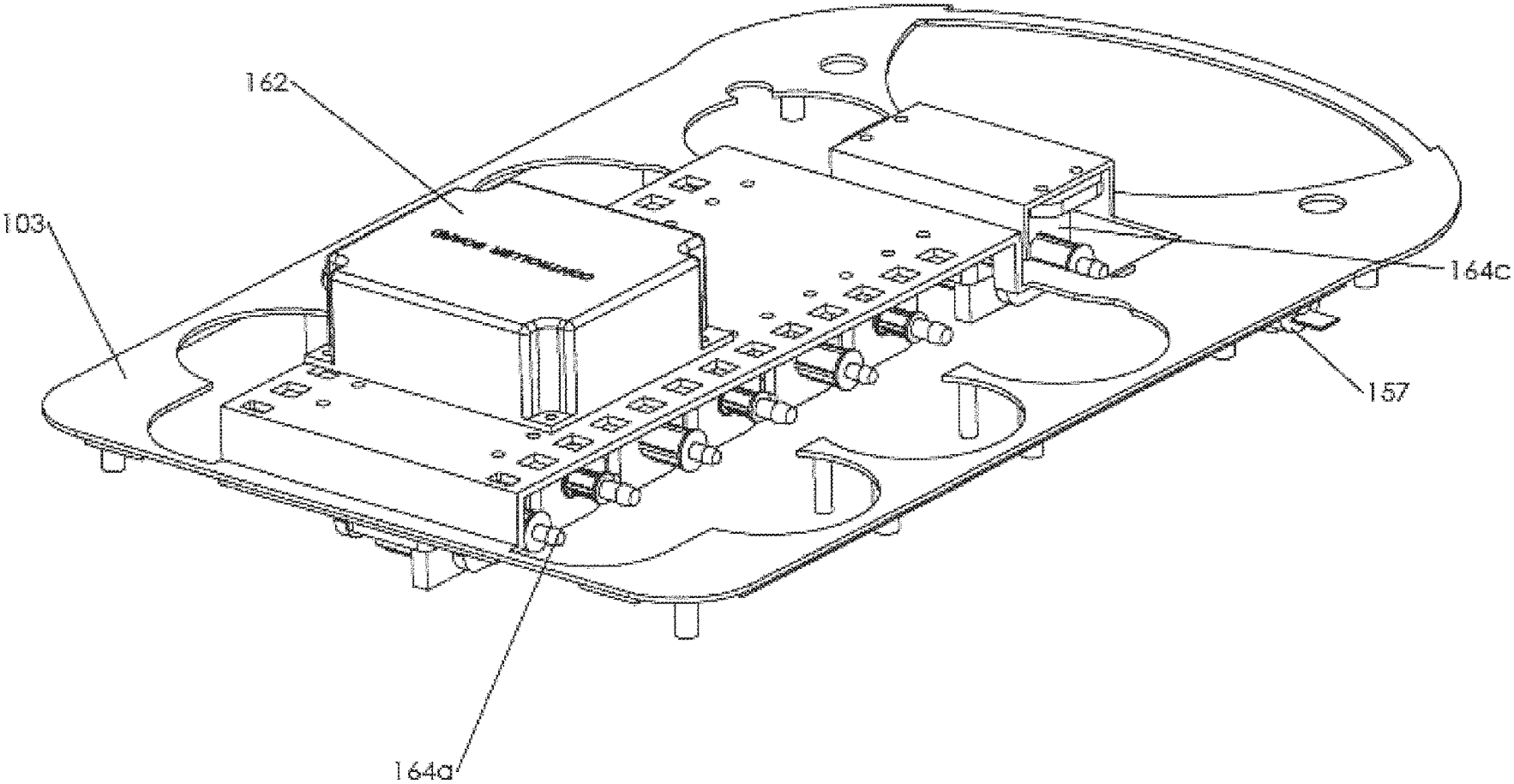
FIG. 7 is an isolated perspective view of the base and pumps of the vending apparatus of FIG. 1.
Figure 9:
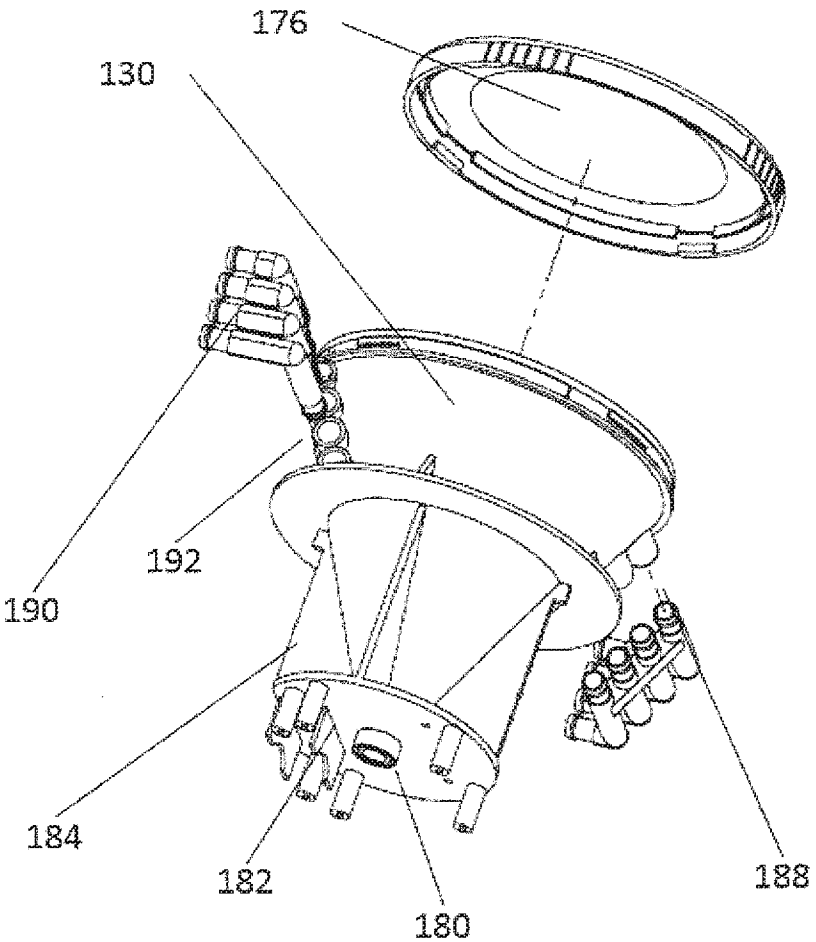
FIGS. 8-9 are two different exploded perspective views of the mixing container of the vending apparatus of FIG. 1.
Figure 8:
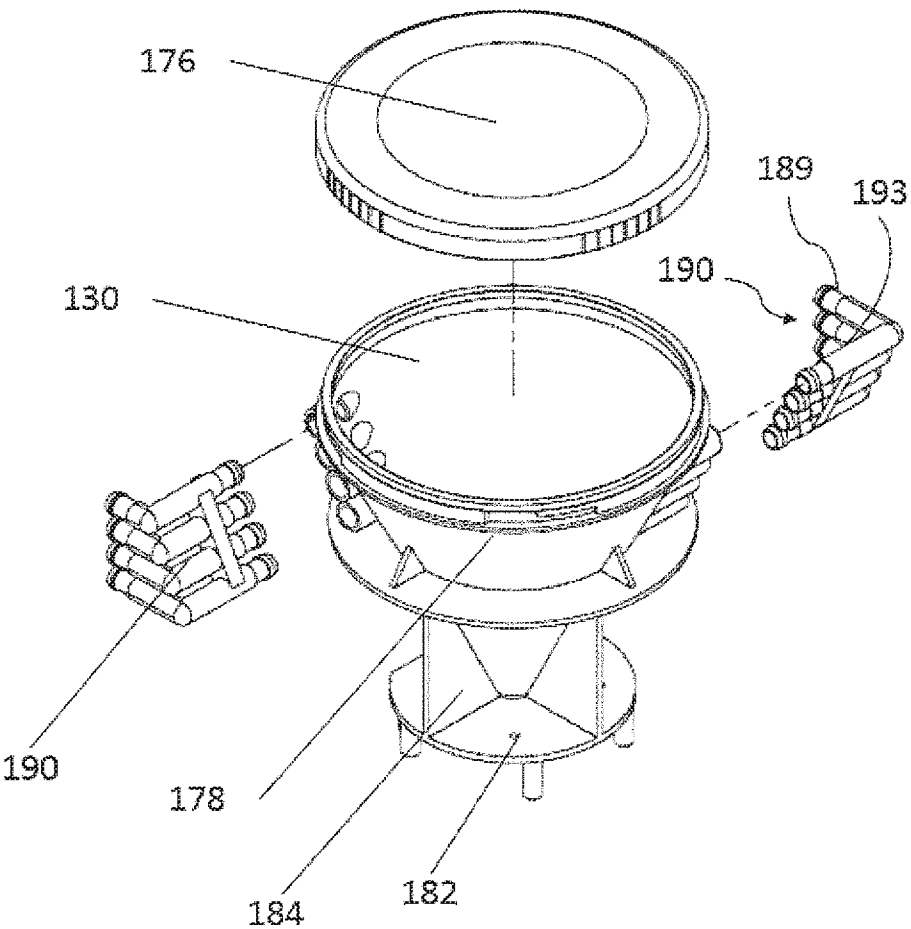
Figure 10:
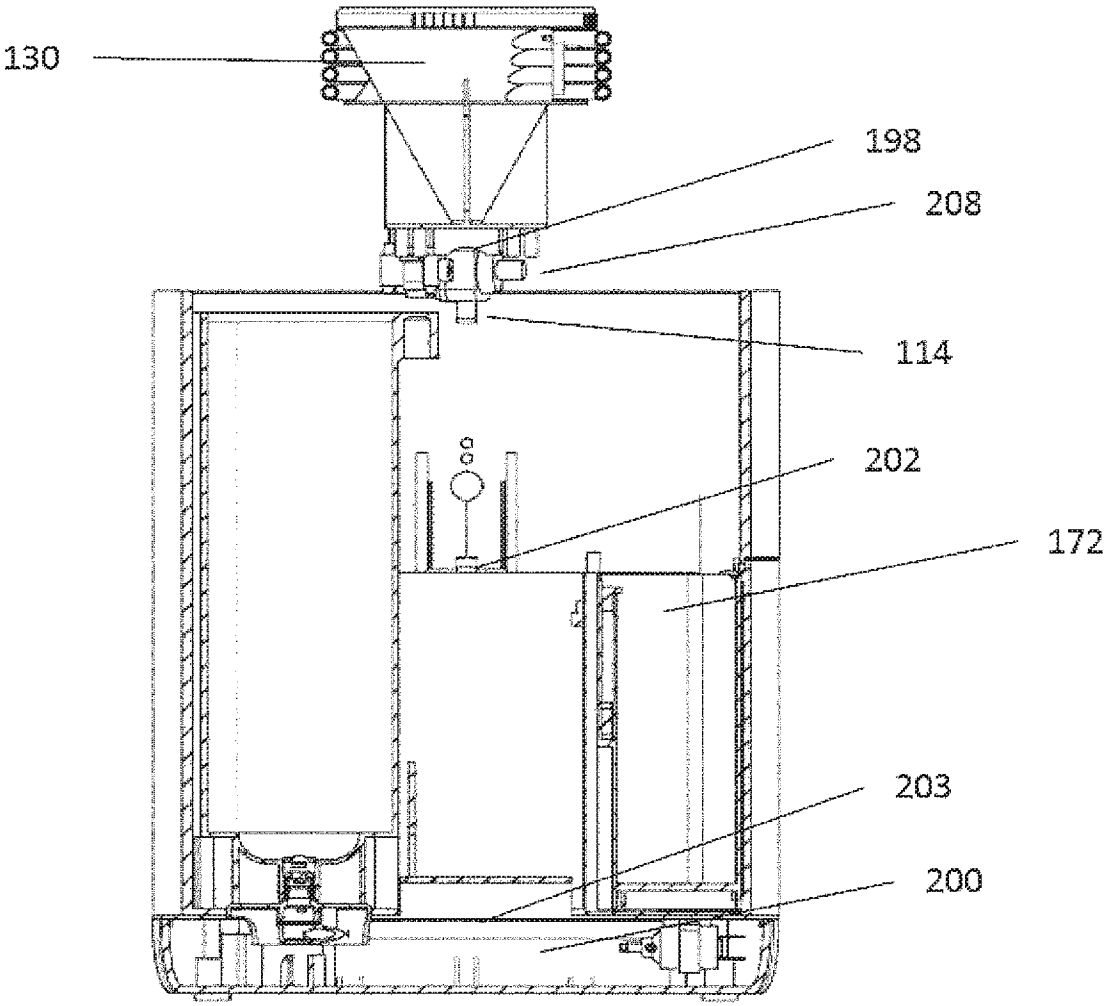
FIG. 10 illustrates the relationship between the mixing container of FIGS. 8 and 9 and the other components of the vending apparatus of FIG. 1.
Figure 11:
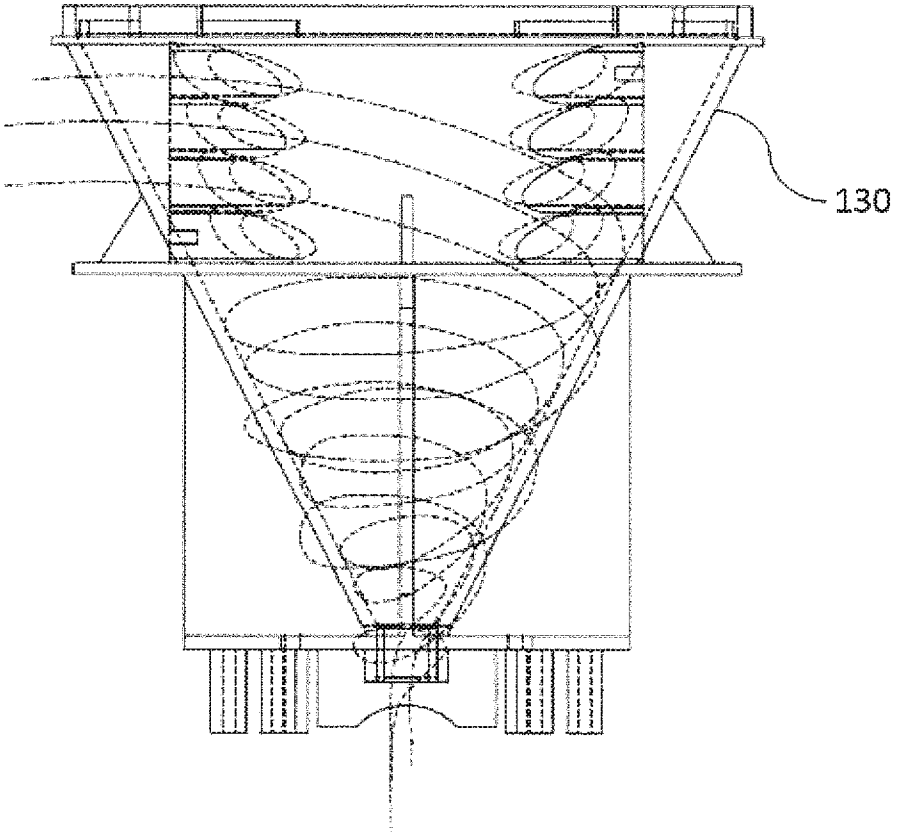
FIG. 11 illustrates the flow path of the liquids inside the mixing container of FIGS. 8-9.

Referring back to FIG. 3B, 3C and to FIG. 7, the ingredient pumps 164 in this embodiment are positioned below the base 103. There are three types of pumps 164: a regular pump 164*a* for pumping individual ingredients from the cartridges 124, a water pump 164*c* that functions to transport water from the clean water container 166 (via the manifold 167) to the mixing container 130, and a micro-pump 164*b* (see FIG. 3A) that transfers liquids from the mini-cartridge 170 via the manifold 173 for use with specialty recipes. Each pump 164 is designated to work with a corresponding cartridge 124, mini-cartridge 170 or container 166 so that the correct pump(s) 164 turn on to allow flow of a particular liquid from that cartridge 124, 170 or container 166, with this location-based information provided by the RFID/NFC system. Pumps 164*a* and 164*b* transport liquid ingredients in the desired quantities and orientation, and can be embodied in the form of any positive displacement or impeller-type pumps with food grade components, and having a compact size for use with a small appliance.

There is also a drain tray 200 positioned in the center of the dispensing area where the receptacle R is kept for product collection with respect to the base 103 and the control board 162. The drain tray 200 is a removable container that functions to collect residual and carryover liquids during use, and is secured to the base 103 by screws 197. The drain tray 200 should be made from a food grade material such as plastic (e.g., Teflon, Nylon, Polyethlyene, Polycarbonate, etc.), glass, or a metal such as stainless steel, and be water proof, light weight, and washable. In the embodiment shown in FIGS. 3C and 3E, e.g., the drain tray 200 mounts to the base 103 with screws, and provides additional structural support for the apparatus 100 as well as to hide the pumps 164 and tubing. A hand grip 205 functions to assist the user in handling the apparatus 100. Screw holes 207 are provided at the drain tray 200 for use in mounting the drain tray 200 to the base 103. One of ordinary skill in the art will recognize that drain tray 200 and base 103 may be have alternative designs, for example to allow drain tray 200 to be slidably connected into a cavity within a base 103 to allow for easy removal and washing of drain tray 200.

Finally, the control board 162 is provided within the apparatus 100. The control board 162 has a microprocessor-embedded control mainframe interacting wirelessly via Bluetooth, Wifi and/or other similar means (e.g., module 165 in FIG. 12) with computing devices like smart phones, tablets, personal computers or data servers. The control board 162 also has switch outputs to drive electro-mechanical components like the pumps and the valves. The control board 162 can accept a time-based or quantity base recipe from a smart phone, tablet or data servers and executes the recipe by turning on designated pumps 164 for the desired time or quantities respectively. The designated cartridge 124 is mapped by the RFID/NFC system feedback in the manner described below. Also, a photo/light proximity sensor and/or electro-magnetic switch 202 may be physically located above the area where receptacle R is kept. to receive product from dispensing nozzle 114, and is electrically coupled to the control board 162 for detection of glass underneath the dispensing nozzle 114. The sensor 202 works by bouncing and receiving reflected laser beams. The laser beam is benign in nature and is at a very low strength. One of ordinary skill in the art will recognize that the detection of a glass in receptacle R, underneath the dispensing nozzle 114, can be accomplished using alternative designs including, without limitation, weight sensors or micro mechanical switches.

Figure 3G:
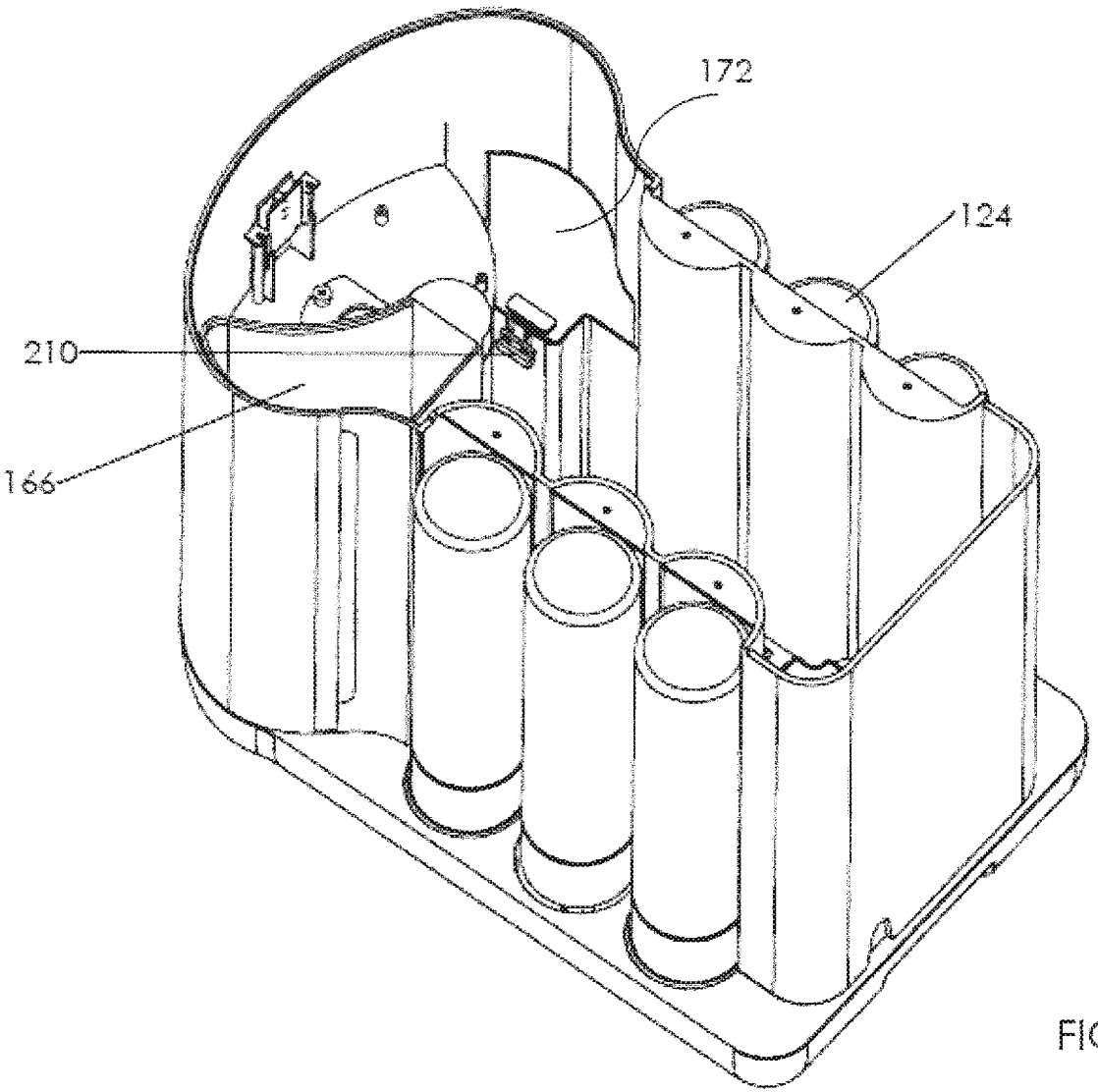
FIG. 3G is a sectional view of part of the interior of the vending apparatus of FIG. 1 shown from the top with the cover removed.
Figure 3H:
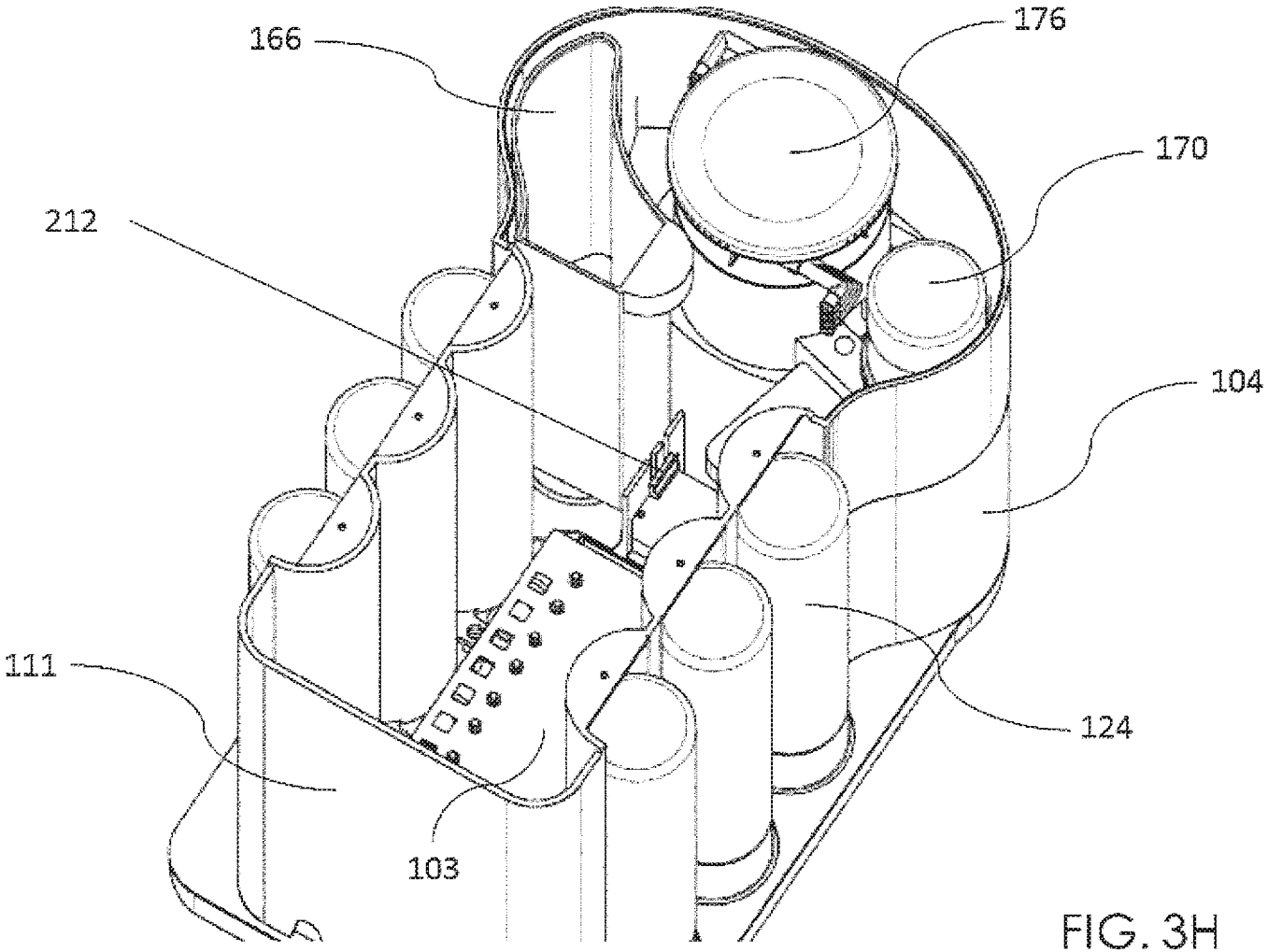
FIG. 3H is another top perspective view of the vending apparatus of FIG. 1 with the cover removed.

Referring to FIG. 3G, a waste water sensor switch 210 is mounted on a separate wall in the inner space 115 of the front section 104, and is aligned with the straight-edged wall of the waste water container 172 to detect and send a pulse signal via wires to the control board 162 to send alerts when liquid contents in the waste water container 172 are full. When the waste water sensor 210 detects a full waste container, an alert will be triggered. Until the alert is cleared, operations of the apparatus 100 will be suspended or paused.

Figure 4:
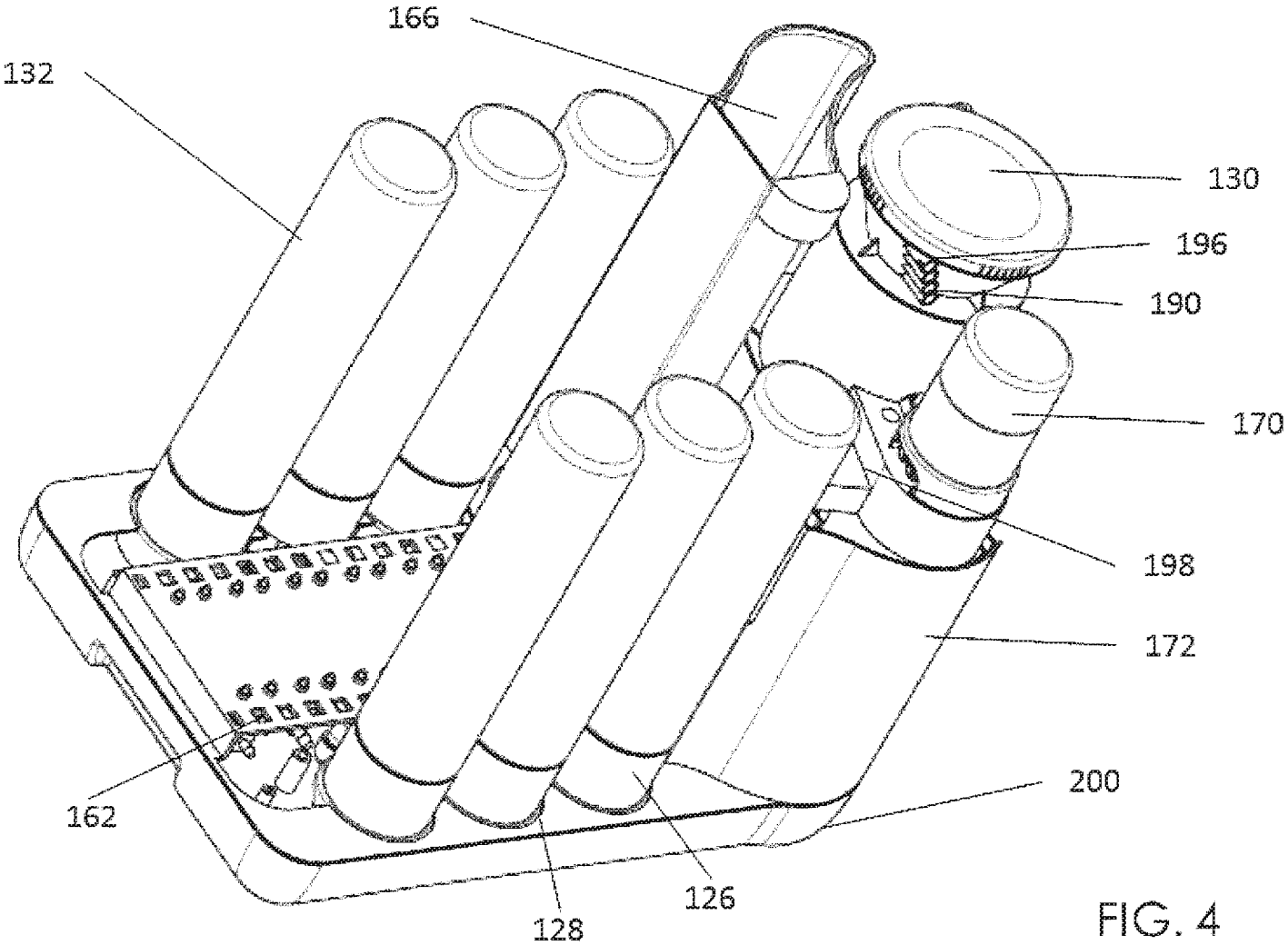
FIG. 4 is a perspective view of the internal components of the vending apparatus of FIG. 1 shown with the housing removed.
Figure 5:
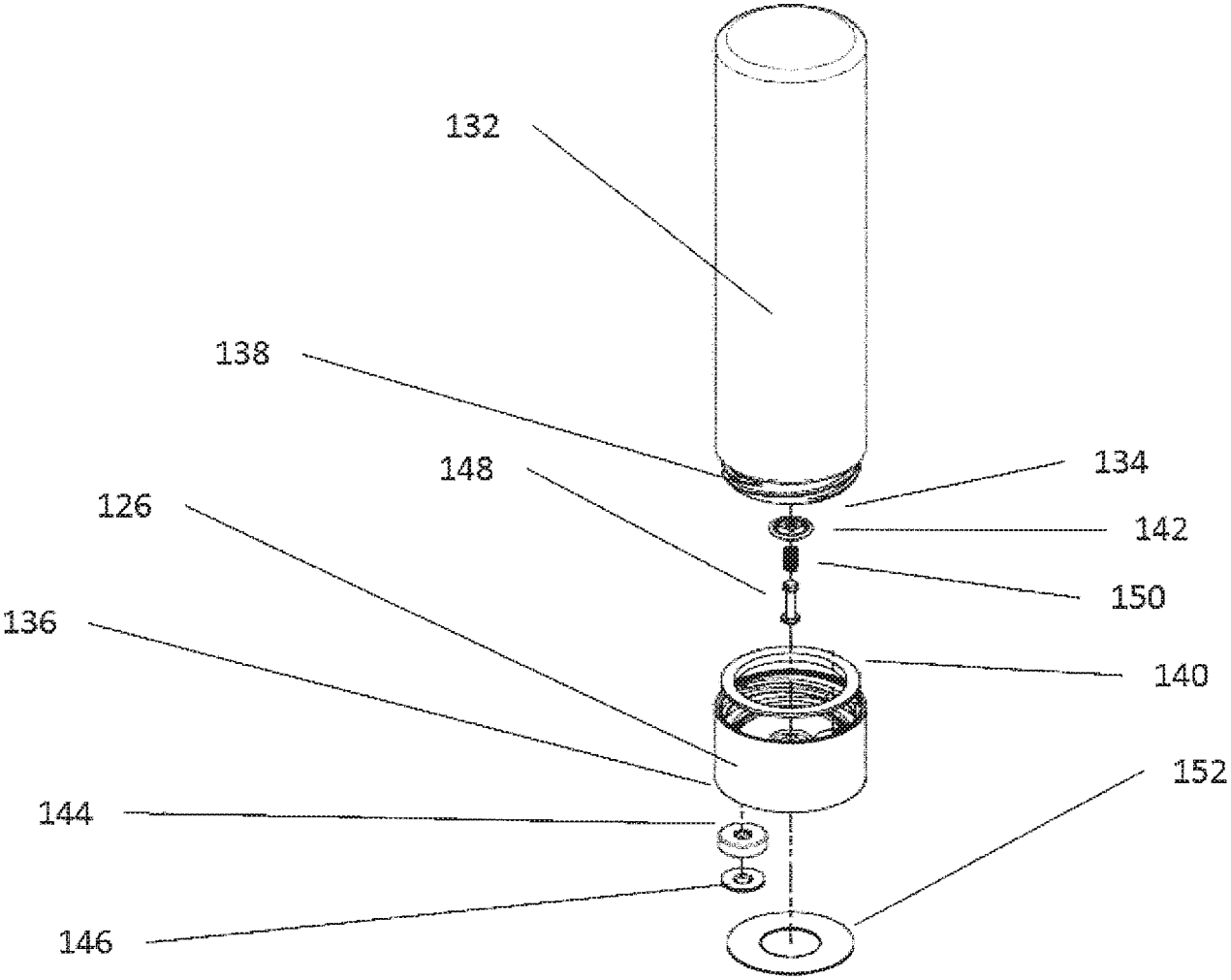
FIG. 5 is an exploded perspective view of an ingredient cartridge for the apparatus of FIG. 1.

Referring to FIG. 4, a clean water sensor switch 212 is mounted on a separate wall in the inner space 115 of the front section 104, and aligned with the straight-edged wall of the water container 166 to detect and send a pulse signal via wires to the control board 162 to send alerts when liquid contents in the water container 166 are empty.

Operation of First Embodiment

The interaction and control of various elements of the apparatus 100 are controlled via the control board 162, power supplies and other electrical circuit components, as shown in greater detail below. The controller 165 on the control board 162 is connected to software application via Bluetooth, Wi-Fi or other such similar means that are familiar to a person skilled in the art. This software application commands the controller 165 on the control board 162 via Bluetooth and/or Wi-Fi signal. The controller 165 is electrically connected to the pumps 164 and the three-port diverter valve 198. The flow of liquid is from the cartridge container 132 to the lid 126 and then into the manifold 128 through a fitting on manifold top 154. The liquid then flows from the manifold 128 to the pumps 164 through a food grade connection 204 on the manifold bottom 156. The liquid is then pumped via tubing 223 (see FIG. 3F) through the lines 193 of the fitting 190 into the mixing container 130, where the ingredients are mixed. Alternatively, liquid may be pumped via tubing 223 into a combined line (i.e., a mixing channel) which then delivers the combined ingredients into mixing container 130. From the mixing container 130, the mixed drink is flowed through the three-port diverter valve 198 and through the nozzle 114 to be dispensed into a drinking container.

The flow of the liquid from the mini-cartridge 170 is similar. Liquid from the mini-cartridge 170 is pumped by the micro-pump 164*b* through its manifold 173 via tubing (e.g., similar to 223) to the mixing container 130.

The cleaning or rinsing can be initiated by the user through the mobile application remotely using a smart device. During a cleaning or rinsing cycle, the water pump 164*c* pumps water or a cleaning solution from the water container 166 through the manifold 167 to a tubing (not shown) that delivers the water to the water inlet 188 via a line 189. The water is then flowed through the three-port diverter valve 198 to a waste outlet 208 in the three-port diverter valve 198 that carries the liquid to the waste water container 172. The waste from the waste container 172 is removed manually by the user after the sensor switch 210 (see FIG. 3G) alerts the user for this action. During a system flush cycle (after all cartridges 124 or 170 are removed from the apparatus 100), the water from water container 166 travels from water manifold 167 to the two-port valve 157 and into wash port 159 on each manifold 128. The pump 164*a* then transports water from the manifold 128 into mixing container 130 via the water inlet 188 into the waste water container 172 going through the three-port diverter valve 198.

The software application is downloaded to a smart device such as a tablet, smartphone, personal computer, or other similar device and is used via a software application. The software application contains cocktail menus, both fixed and programmable. Further, the cocktail menu can be adjusted or limited by the software application based on the ingredients loaded into the apparatus 100 through the plugged-in cartridges 124. As the control board 162 determines the contents of each cartridge 124, the information is relayed to the software application, which then updates the cocktail menu based on the ingredients available to the apparatus 100. A cocktail can be "ordered" or selected from the software application's menu. If a user selects a cocktail for which ingredients are not presently loaded onto the apparatus 100, the software will issue an alert to the user and guide the user to either select another cocktail for which ingredients are present or insert cartridge(s) 124 with the missing ingredient(s) into the manifold 154. Further, through the software application multiple users can synchronize or log-into a single apparatus 100 to access the provided menu and to order cocktails. Finally, through the software application users are able to adjust cocktail recipes based on either time or ingredient quantities, according to personal preference.

Figure 21:
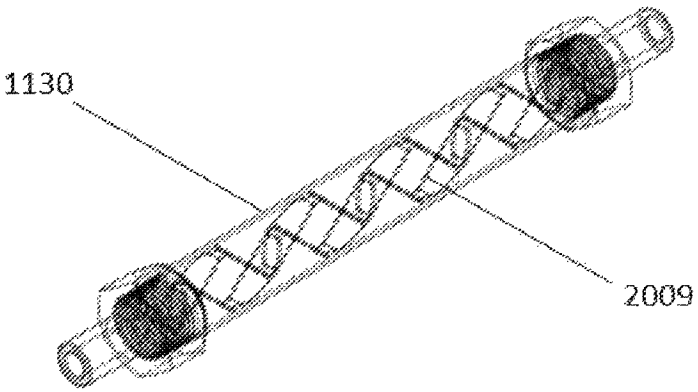
FIG. 21 is a perspective view of the mixing well of the vending apparatus of FIG. 16.

When a drink is "ordered," the software application sends a command to the control board 162 via Bluetooth, Wifi and/or other similar means, with the recipe for the selected cocktail. Once the software command is received the control board 162 activates one or multiple ingredient pumps 164 which draw one or a combination of ingredients from the appropriate cartridges 124, which could include liquor, mixers, water, or dashes (i.e. bitters or such aromatic liquid condiments). The ingredient pumps 164 move the ingredients from the cartridges 124 and into the mixing container 130 where the ingredients are thoroughly mixed by being transported through curved surfaces to generate cyclonic action (see FIG. 11) caused by centrifugal forces or other obstructing object or objects (see FIG. 21). The liquids are inserted into a circular walled container with velocity, along the circular walls creating a cyclone like action. The narrow bottom of the mixing container 130 creates a path of increasing velocity as the liquid travels down the container guided by the curved walls thereby creating a mixture of centripetal and centrifugal forces in-situ mixing effect by fluid dynamics before dispensing the liquid. The ingredient, or mixed ingredients, is then transferred to a drinking receptacle R (e.g., glass or cup) via the dispensing nozzle 114, gravity, pumps, or any other positive displacement mechanical device. Following the production of a cocktail, if deemed necessary by the system or manually requested by the user, the apparatus 100 then goes through a water flush process in which water is transported from clean water container 166 via a water pump 164*c* and the mixing container 130, and then through the dispenser nozzle 114. The waste from this water flush is collected in a waste water container 172.

If at any point during operation, a cartridge 124 becomes empty or is disconnected from the apparatus 100, the control board 162 will trigger an alert to the software application on the user's smart device, tablet, personal computer or server via Bluetooth, Wifi and/or other similar means. Until the alert is cleared, operations of the apparatus 100 will be suspended or paused.

Electronic Tagging and Monitoring System

Currently all consumer appliances which are involved in liquid food preparation involve various ingredients and/or components. Specifically, for cocktail mixing or juice making machines, there is no way for the user to electronically keep track of the ingredients in different containers. Current systems use manual dial-type indicators on the containers to notify users of its contents.

The present invention provides the apparatus 100 with a system and method of electronically tagging and monitoring the contents of each cartridge 124. The electronic tagging and monitoring system uses radio frequency identification (RFID) or near field communication (NFC) processes to transmit and store data (e.g., branding, product and manufacturing information) into metallic coils acting as tags (e.g., 152) on the cartridges 124. The information stored in the tags is used for monitoring (e.g., within the realm of machine operation for automatic detection) and marketing (e.g., send alerts and customer usage data to a virtual database for analysis).

The monitoring feature manages (but is not limited to) inventory management, cleaning protocols to avoid cross contamination, and global identification of customized ingredients. This is accomplished by reading and writing unique codes on the tags, where the codes are stored for an indefinite period of time until the information is replaced. The automatic detection provides a faster way for users to track the contents of the cartridge 124 in multiple-user or machine-network scenarios.

The electronic tagging system assists in marketing by saving the data (e.g., product branding, product specifications and manufacturing information) in a cloud-based database via a smart device to analyze users' behaviors with respect to making cocktails and specific brand usage for advertising and promotional purposes. Users can store or read information in the tags via smart devices such as phones, tablets, etc. The tags 152 are•embedded on the detachable lid 126 of the cartridges 124, and these tags 152 interact with a metallic coil acting as an antenna 158 mounted in the manifold top 154 where the cartridge 124 is inserted into. These tags 152 can be either writeable or re-writeable depending on refillable or pre-packaged applications for consumer use. The mobile application initiated data may also be transmitted directly between a user's smart device and the RFID/NFC tag 152.

The data transmission is controlled by a multiplexing circuit 155 (see FIG. 12) with remote antennas 158 mounted on each individual manifold top 154. The multiple manifold tops 154 can relay real time data from the tags 152 to the multiplexer 155 specific to its location within the apparatus 100. The controller 165 constructs a digital input/output map of the operations of the apparatus 100. The locations of these manifold tops 154 are also digitally mapped within the software of the multiplexer 155 to manage data traffic efficiently during operation. This mapping feature helps to identify where a specific cartridge 124 is located within the bank of multiple cartridges 124, and to identify the contents stored in each cartridge 124. Unlike conventional RFID or NFC proximity-based tracking, the multiplexer 155 and its remote antennas 158 or PCBs mounted on individual cartridge manifolds provide accurate information specific to each location of the manifold tops 154 within the realm of the apparatus 100.

Figure 14:
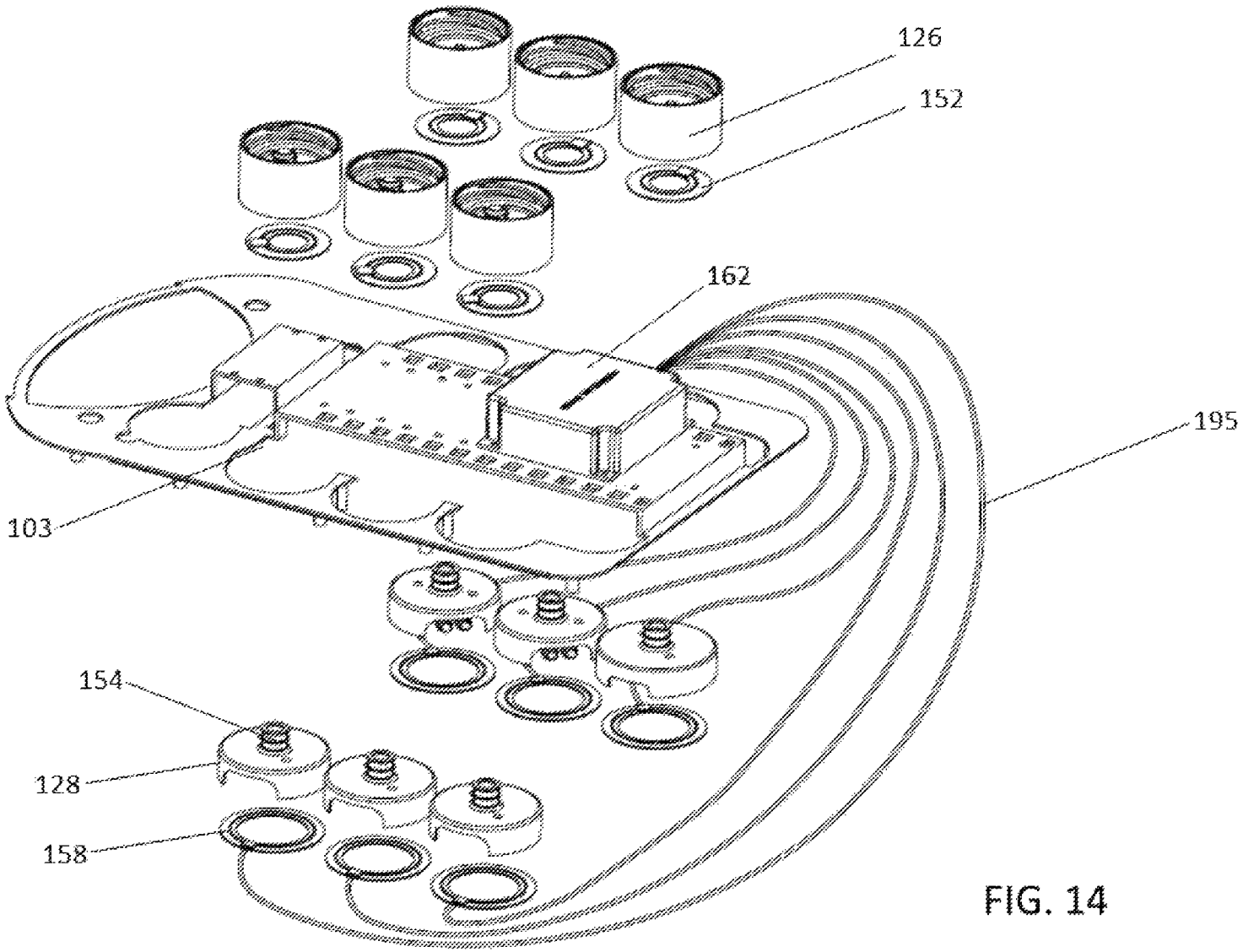
FIG. 14 is an exploded perspective view of the internal components of the tagging and monitoring system of the vending apparatus of FIGS. 1, 2 and 13A-13B.

The multiplexer 155 on the control board 162 controls the interaction between the tags 152 and the smart devices in a wireless manner There are electrical wires 195 (see FIG. 14) connected from the RFID/NFC antennas 158 to the control board 162 to carry signals and data. The RFID/NFC tags 152 communicate wireless with the antennas 158. When a request of reading or writing data (e.g., branding, product or manufacturer information) is initiated by the user via his or her smart device, tablet, personal computer or server, the multiplexer 155 accepts the request and sends an inquiry to the desired location calling for data stored in the RFID/NFC tag 152 via the remote antennas 158. If a status of any of the locations or the associated tags 152 changes (i.e. when a user plugs in or takes out a cartridge 124 from its manifold location), the multiplexer 155 receives a notification of the status change which is transferred to the smart device instantaneously as an alert on the mobile application installed by the user in the smart device.

The RFID/NFC tag 152 and antennas 158 can be metallic coils wrapped on a PVC disk with an IC chip attached to both. The IC chip in the RFID/NFC tag 152 stores data transmitted by control board 162 via the RFID/NFC antenna 158. There is one RFID/NFC reader/writer module in control board 162 (see FIG. 12) which controls interactions between all RFID/NFC antennas 158 and the control board 162.

Figure 12:
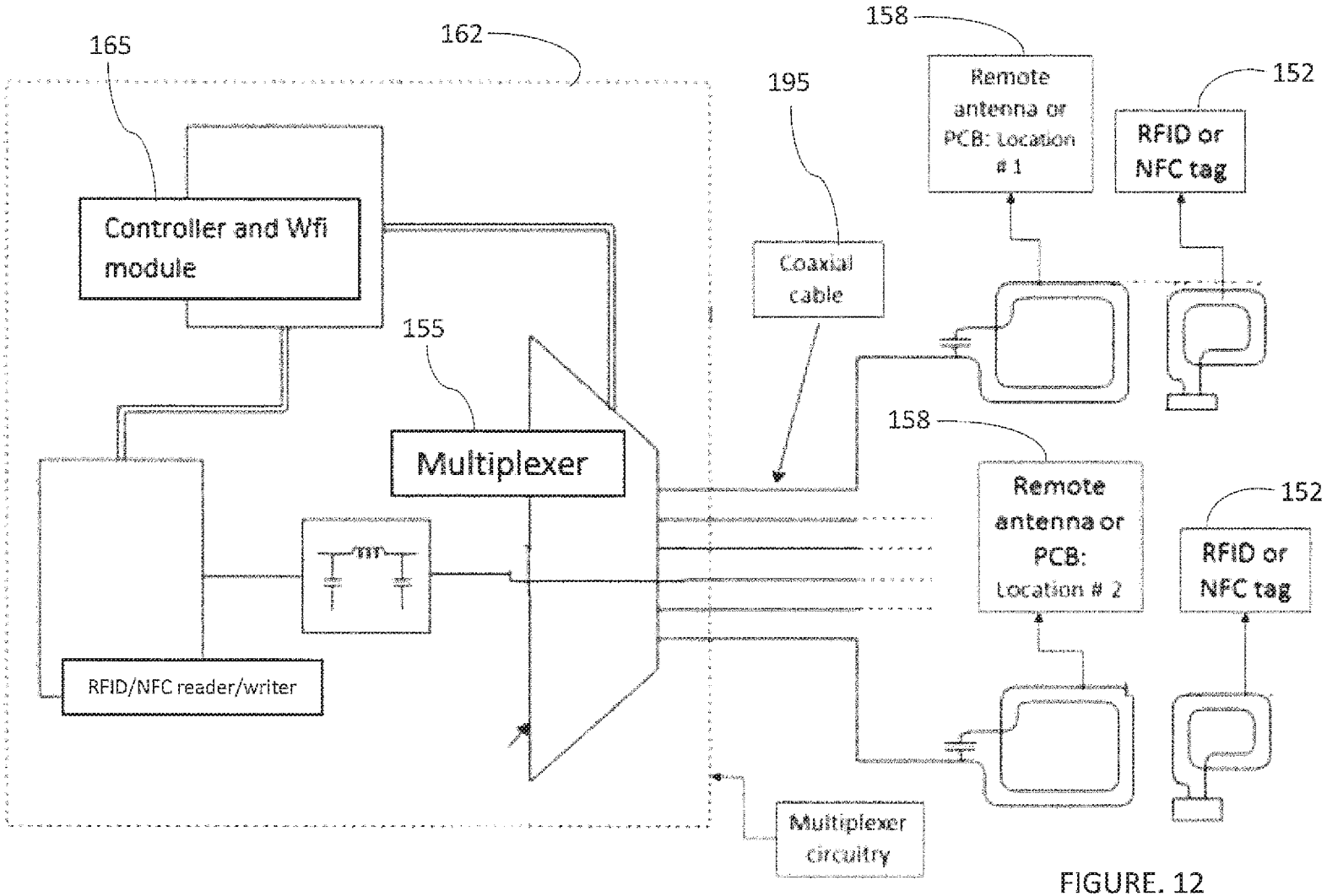
FIG. 12 is a schematic diagram illustrating the electronics of the vending apparatus of FIG. 1.

FIG. 12 shows the control scheme of the electronic tagging system. The remote antenna or PCB 158 will interact with RFID or NFC tags 152 and transmit information stored in the tags 152 to the multiplexer 155 through the coaxial cable or wiring 195 or any such signal grounded wire type. FIG. 12 also shows expansion wires for more than two locations for bigger capacity applications. The data can be read or written via wireless interaction between the RFID/NFC tag 152 and the RFID/NFC antenna 158 to provide accurate and real time monitoring. The data (e.g., branding, product or manufacturing information) read or written in the tags 152 can be used for monitoring and marketing purposes. The data stored in the RFID/NFC tag 152 can also be read by other external RFID/NFC readers embedded in smart devices or other electronic devices.

Figure 13A:
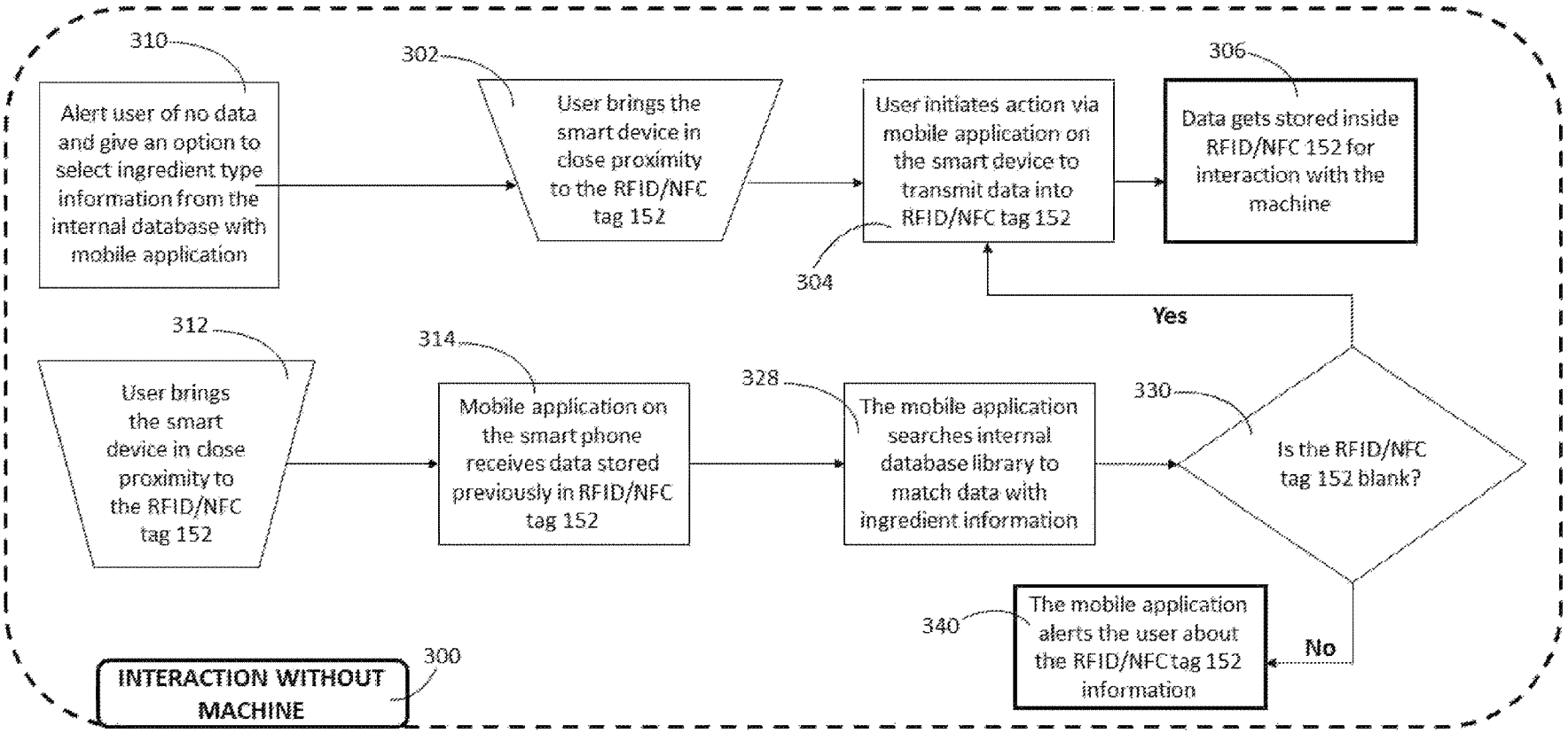
FIGS. 13A and 13B are flowcharts illustrating the operation of the tagging and monitoring system of the present invention.
Figure 13B:
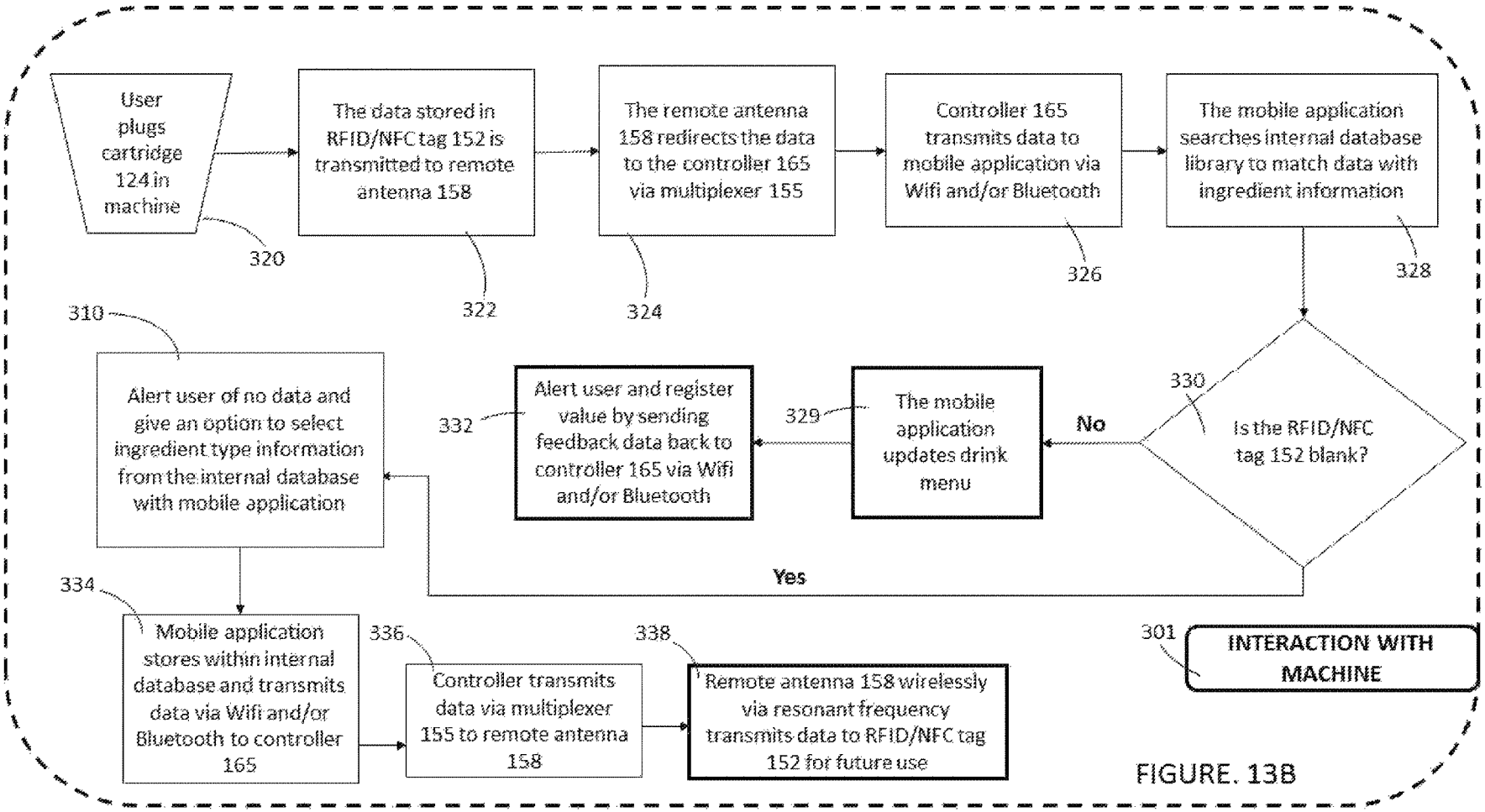

FIGS. 13A and 138 are flowcharts showing how the data is transferred and manipulated by the electronic tagging and monitoring system of the present invention. The method involves two stages, a first stage 300, shown in FIG. 13A, where a new cartridge 124 is established, and a second stage 301, shown in FIG. 138, where the established cartridge 124 interacts with the control board 162 of the apparatus 100.

In the first stage 300, the user can either (i) store data for later use (see step 306) or (ii) scan data on an RFID/NFC tag. Both options can be accomplished by directly using a suitable smart device (phone, tablet or watch) or personal computer. The storage of data (step 306) can be accomplished by bringing the smart device (phone, tablet or watch) or personal computer in close proximity to the RFID/NFC tag 152 which is embedded in the selected cartridge 124 (step 302) and then the user instructs the mobile application to transmit data to the RFID/NFC tag 152 using suitable hardware (step 304). The data is stored indefinitely until software operation in step 304 re-initiates.

The scanning of data is accomplished by bringing the smart device (phone, tablet or watch) or personal computer in close proximity to the RFID/NFC tag 152 which is embedded in the selected cartridge 124 (step 312), and then the user instructs the mobile application to receive data from the RFID/NFC tag 152 (step 314), after which the mobile application searches the internal database library for matching information (step 328). If the search in step 328 matches information in the internal database library (step 330), the mobile application alerts the user in step 340 of the RFID/NFC tag information. If the search does not match information in the internal database library in step 330, then processing proceeds to step 304 where the user instructs the mobile application to transmit data to RFID/NFC tag 152 using suitable hardware, and in step 306, the data is stored in RFID/NFC tag 152 indefinitely until software operation in step 304 re-initiates.

In the second stage 301, the user plugs a cartridge 124 into the vending apparatus 100 in step 320. Immediately after the cartridge 124 is inserted into the corresponding manifold 154, the remote antenna 158 receives the data in step 322. Next, in step 324, the remote antenna 158 transmits location based (i.e., identifying which one of the six manifolds 154 it is interacting with) data via the multiplexer 155 to the controller 165, and then the data is transmitted to the mobile application on the smart device (phone, tablet or watch) or personal computer by software operation in step 326. Next, in step 328, the mobile application runs software algorithms which search the internal database library within the mobile application to match data with ingredient type information. In step 330, if the search result of the software operation matches with information in the internal database, then the mobile application updates the drinks menu and stores the information (step 329) within the mobile application, and in step 332, sends an alert to the user and registers the value by sending feedback data to the controller 165. In this regard, the software operation in step 332 sends the results back to the controller 165 to notify the control board 162 of the current status of the ingredient types. The data is stored indefinitely until software operation is re-initiated in step 328.

If the search result in step 330 does not match information within the internal database, then in step 310, software operation prompts the user to select ingredient type information (each ingredient type has a unique code in the internal database within the mobile application), and then in step 334, the mobile application on the smart device (phone, tablet or watch) or personal computer first stores data within the internal database and transmits the data to the controller 165 via Wifi and/or Bluetooth or similar wireless means. Next, in step 336, the controller 165 transmits location-based (i.e., identifying which one of the six manifolds 154 it is interacting with) data to remote antenna 158 via the multiplexer 155. Finally, in step 338, the remote antenna 158 transmits data wirelessly via resonant frequency to the corresponding RFID/NFC tag 152 for future use.

One of ordinary skill in the art will recognize that the cartridge 124 and the RFID/NFC tag 152 may be pre-loaded with a particular ingredient and the related information, allowing the user to purchase the pre-loaded cartridge 124 and insert it into the apparatus 100 for automatic detection.

Second Embodiment

FIGS. 15-20 illustrate a second embodiment according to the present invention. The apparatus 100A in FIGS. 15-20 is essentially the same as the apparatus 100 in FIGS. 1-11 and 14, so the same numerals are used in both embodiments to represent the same or corresponding elements, except that an additional "1" has been added in front of the corresponding numeral designations in FIGS. 15-20. For example, pumps 1164 in FIGS. 15-20 correspond to pumps 164 in FIGS. 1-11 and 14. As a result, detailed description of the same or corresponding elements in FIGS. 15-20 shall not be provided.

As seen in FIGS. 16-20, most of the components of the apparatus 100A of the second embodiment may be secured to a component chassis 2000. The internal components of the apparatus 100A can run on AC and DC voltage. This high voltage can then be distributed to voltage transformers (low voltage power). A din rail 2002 may be included to mount terminal blocks to an electrical wiring connection. There may be in-line fuses and surge protectors to provide protection against any irregular electrical activity. The line from the transformers may be connected into one connection end of the pumps or other mechanical devices familiar to someone skilled in the art. In some embodiments, the transformer may not have to be connected to the transfer pump 2006.

The return or neutral connection end goes into the connectors on the main frame control board 1162. Most of the above-mentioned hardware can also be mounted to the exterior housing via din rail, fasteners, panels, adhesives, or other similar hardware familiar to someone skilled in the art.

Interaction and control of various elements of the apparatus 100A are controlled via the control module 1162 which functions in a similar manner as control board 162. The control module 1162 is connected to software application via Bluetooth and/or Wifi or other such similar device familiar to someone skilled in the craft. The software application is able to send commands to the control module 1162. The control module 1162 is connected to the transfer pump 2006, ingredient pumps 1164*a*, mini-pump 1164*b*, pump 1164*c* and a three-way valve 1198. A cleaning solution container 1166 can be connected to the pump 1164*c*, and functions to store or hold cleaning solution.

Figure 17:
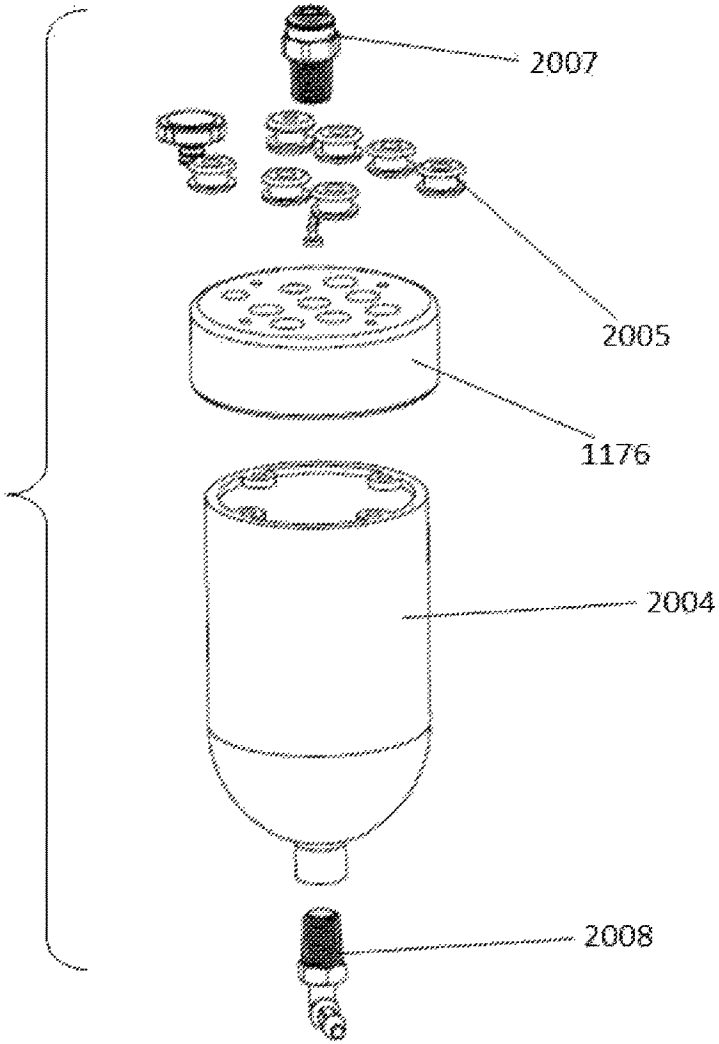
FIG. 17 is an exploded perspective view of the ingredient well for the embodiment of FIG. 16.
Figure 18B:
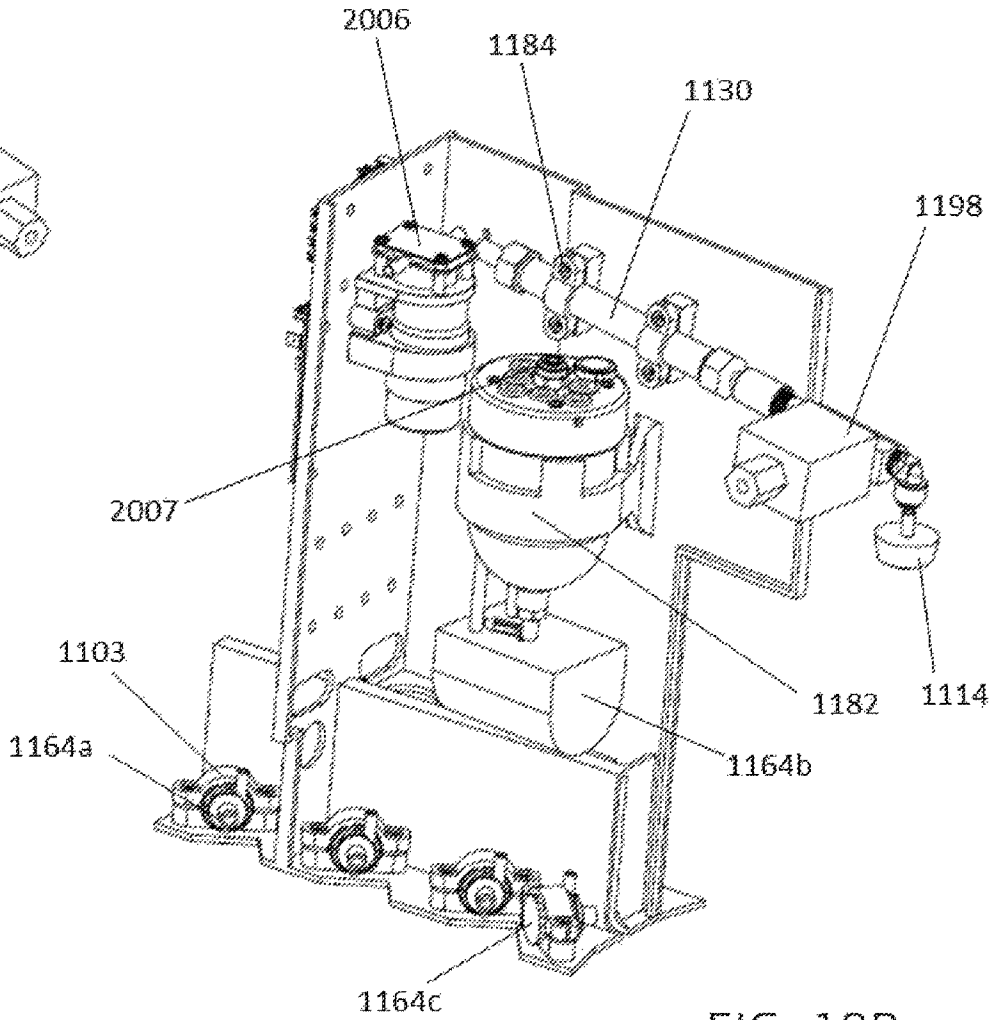
FIGS. 18A and 18B are different perspective views of the internal components of FIG. 16 with the components shown in assembled form, shown with the housing removed.
Figure 18A:
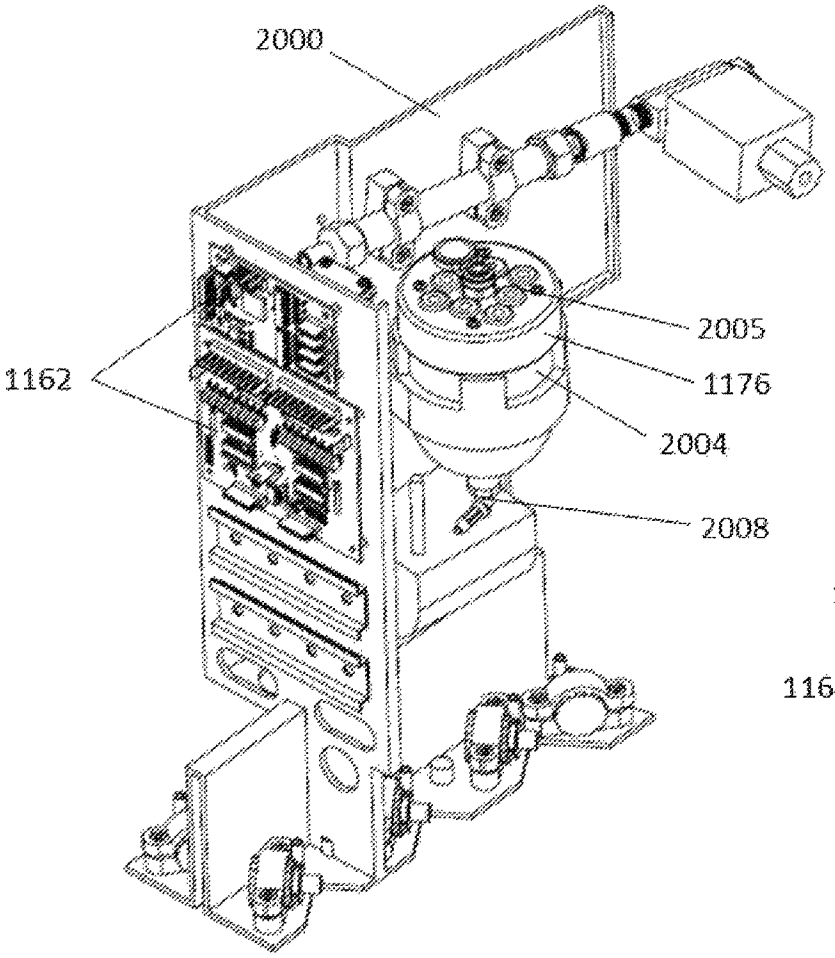
Figure 19B:
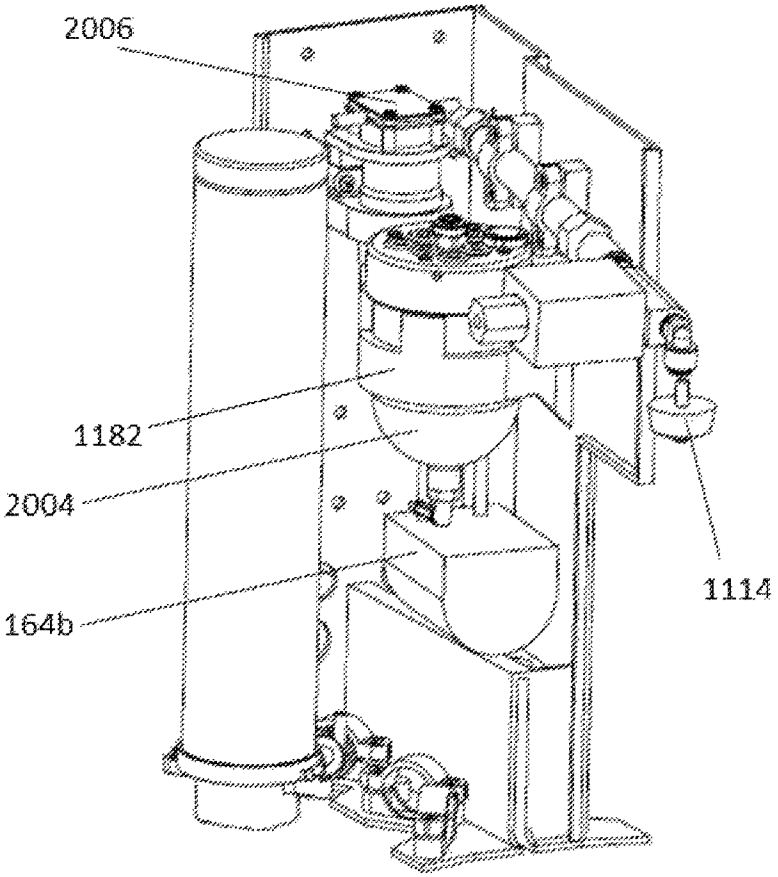
FIGS. 19A and 19B are different perspective views of the internal components shown in FIGS. 18A and 18B but with the inclusion of an ingredient cartridge.
Figure 19A:
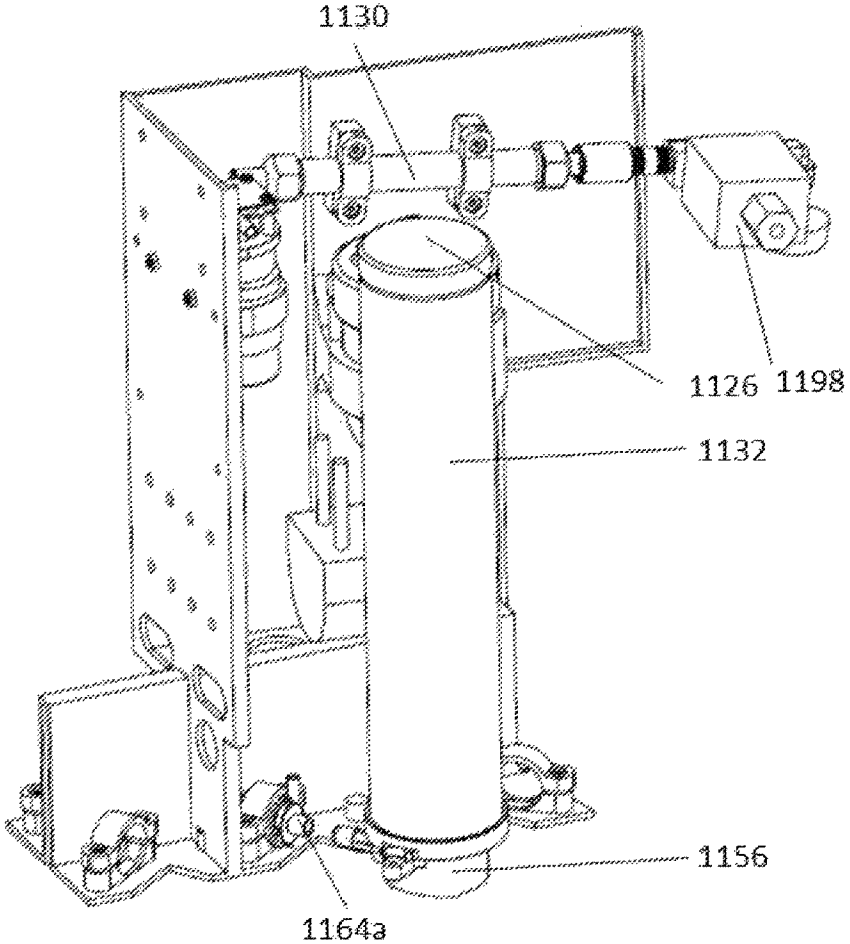
Figure 20:
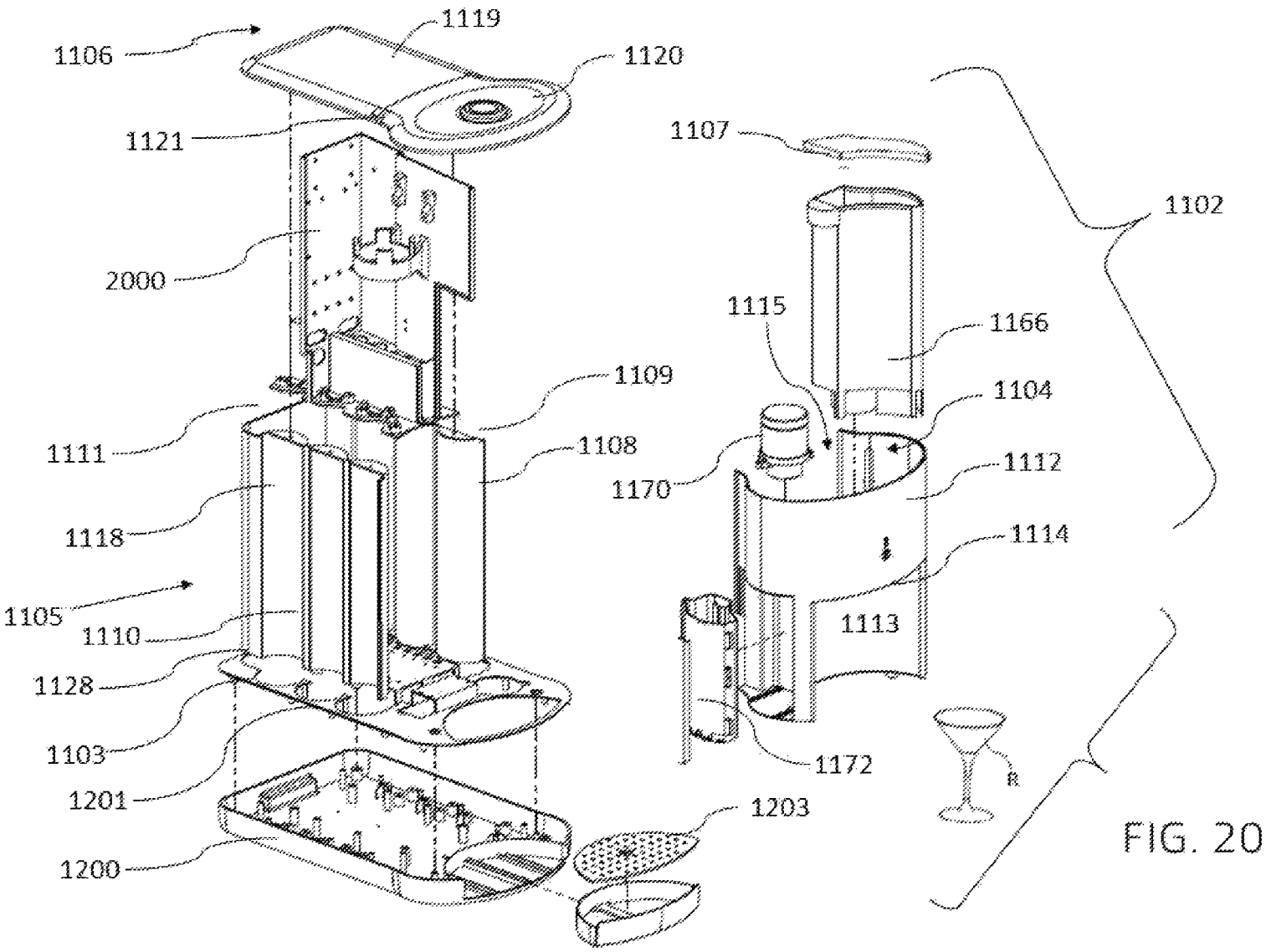
FIG. 20 is an exploded perspective view of the housing and some of the internal components of the vending apparatus of FIG. 16.

Tubing and/or hosing (not shown in FIGS. 16-19B but similar to 223) is connected from the pumps 1164*a*, 1164*b* and 1164*c* to the inlet fittings 2005 and the spray nozzle 2007 via check valves or other single direction valves which prevent backflow familiar to someone skilled in the art. The tubing and/or hosing utilized is preferably food grade plastic tubing. As shown in FIGS. 18A and 188, the pumps 1164*a* and 1164*c* are situated near the bottom of the apparatus 100A and are secured to the component chassis 2000 via brackets 1103. The inlet fittings 2005 and the spray nozzle 2007 are attached to a well lid 1176 which may be removable or secured to the well 2004. The well 2004 may be secured to component chassis 2000 via a well holder 1182. FIGS. 17 and 18A-18B show the primary components in and around the well 2004. The outlet side of pump 1164*c* is connected to the well 2004 via ingredient inlet fitting 2005. The software application is able to transmit commands to the control module 1162, which causes the ingredient pump 1164*a* and mini pump 1164*b* to feed ingredients from respective containers 1132 and 1170 to the well 2004. The liquids then flow from the well 2004 through transfer pump 2006 via fitting 2008 into the motionless mixing device 1130. The motionless mixing device 1130 is secured to the component chassis 2000 via brackets 1184. The liquid then flows through three-way valve 1198 into either a dispensing nozzle 1114 or to a waste water container 1172 via waste outlet 1208.

In operation, when a cartridge 1124 is inserted into a manifold bottom 1156, the liquid flows from the inside cavity of the container 1132 or the container 1170 and into the manifold bottom 1156. Each of the respective ingredients housed in the containers 1132 may be pumped into the well 2004 via a respective inlet fitting 2005. After each respective ingredient is accumulated in the well 2004, the transfer pump 2006 is activated, causing the liquid to exit the well 2004 via the fitting 2008 into the entry 1190 of the motionless mixing device 1130. The ingredients are thoroughly mixed in the motionless mixing device 1130 by being transported through or over blades, grooves, or other such obstructing object or objects 2009 (see FIG. 21) familiar to someone skilled in the art of motionless mixing. Alternatively, motionless mixing device 1130 and well 2004 may be combined into one unit for combining and mixing ingredients prior to being dispensed. If the motionless mixing device 1130 and the well 2004 were to be combined, the liquid transfer pump 2006 and associated tubing and/or hosing that connect the well 2004 to the motionless mixing device 1130 could be eliminated.

Referring back to FIGS. 18A-19B, the ingredient, or mixed ingredients, having passed through the motionless mixing device 1130, is then transferred out of the exit 1180 of the motionless mixing device 1130 and to dispensing nozzle 1114 via a three-way valve 1198. Liquid may be dispensed into to a receptacle of the user's choosing via gravity, pumps, or any other positive displacement mechanical device, such as the dispensing nozzle 1114. A receptacle, such as a glass or cup, may be placed under dispensing nozzle 1114. The drain tray 1200 is used to collect residue liquids during operation for the user to manually clean the residue liquids. This drain tray 1200 is removable and dishwasher safe.

The embodiment shown in FIGS. 16-20 further includes a flushing system for cleaning ingredient residue. Tubing (not shown) comprising a cleaning solution line connects the cleaning solution container 1166 to the well 2004. The pump 1164*c* pumps water from cleaning solution container 1166 into the well 2004 via the spray nozzle 2007. The cleaning through spray nozzle 2007 for residue ingredients can be conducted using cleaning solution, water or moist pressurized air. If moist pressurized air is utilized, the humidity of this air stream may preferably vary from 10%-100%. The air streams may be like a jet, knife, blade, bubble or free flow or any other physical nature of air stream familiar to someone skilled in the relevant art of cleaning. After having been flushed through the system, the waste water or cleaning solution is routed through the three-way valve 1198 and into a waste container 1172. Alternatively, the waste water or cleaning solution may be dispensed via the dispensing nozzle 1114. The water flushing cycle of the invention can be changed, altered, or redesigned to include additional functionality, such as PH sensors, ethanol filtration, or other flushing and/or filtration techniques, methods, and/or hardware familiar to someone skilled in the art.

Regarding the cartridge 124, one of ordinary skill in the art will understand that the cartridge 124 may be assembled in a variety of ways, as illustrated by the cartridge 1124 in FIG. 15. Referring to FIG. 15, the lid 1126 may be placed at the end opposite of the cartridge 1124. In this embodiment, the pouring of ingredients is done by removing the cartridge lid 1126. Alternatively, the cartridge containers 1132 may be sealed as pre-packaged contents and/or function like disposal containers. A valve 1146 ensures that the contents of the containers 1132 remain under positive pressure. A gasket 1140 and a gasket sleeve 1144 also assist in this objective. The valve 1146 restricts liquid flow (for leakage) and allows gas/vapor to permeate through. On the opposite end, a manifold top 1154 ensures a fastened surface connection to avoid liquid leakage. A gasket 1142, a stem 1148 and a spring 1150 are further provided and function as previously discussed with respect to gasket 142, stem 148 and spring 150. Another gasket 1158 is compressed to provide a liquid tight seal while making it easy to attach or detach the cartridges 1124. The mechanical valve and/or fitting does not allow liquid to flow out of the cartridge container 1132 during transport or handling until engagement by the manifold bottom 1156. The manifold bottom 1156 may or may not be attached to the outer or inner casing for ease of assembly. Regardless, a pump 1164 is included so as to pump liquid out of the container 1132 via the manifold bottom 1156. As shown in FIG. 15, the electronic tag 1152 may be housed within the lid 1126. The components housed within lid 1126 may be secured to the open end 1134 of container 1132. Furthermore, the cartridge 1124 may contain liquid sensing electronics which aid in easing the use and maintenance of the apparatus 100 and 100A, and its cartridges 124 and 1124. For example, the cartridge 1124 may include a sensor to detect fluid levels and electronics to trigger an alarm and notify the user of some condition such as low fluid level in a container 1132.

The above description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, mechanisms and methods are omitted so as to not obscure the description of the present invention with unnecessary detail.

What is claimed is:

1. A drink vending apparatus, comprising:

a plurality of ingredient cartridge slots configured to receive a corresponding plurality of ingredient cartridges;

a mixing container;

a control unit configured to control selective dispensing of ingredients from all ingredient cartridges into the mixing container and dispense mixed ingredients from the mixing container into a receptacle in response to a drink request;

a plurality of two-port valves, each two-port valve provided with one ingredient cartridge slot; and a plurality of fluid passageways comprising a series of first fluid passageways each connecting a first opening of each of the plurality of two-port valves with a cleaning solution container and a series of second fluid passageways connecting a second opening of each of the plurality of two-port valves with the mixing container;

wherein the control unit is further configured to cause the cleaning solution container to disperse cleaning solution through the first series of passageways, through each two-port valve, and subsequently through the second series of passageways to the mixing container, thereby flushing the first series of fluid passageways, each two-port valve, and the second series of fluid passageways.

2. The drink vending apparatus of claim 1, further comprising a waste container;

wherein the control unit is configured to:

dispense cleaning solution from the cleaning solution container into the mixing container; and expel contents of the mixing container into the waste container via an outlet.

3. The drink vending apparatus of claim 1, wherein the mixing container includes one or more fittings through which different ingredients can be introduced into the mixing container from respective ingredient cartridges, and an outlet whereby the mixed ingredients exit the mixing container.

4. The drink vending apparatus of claim 1, wherein the control unit is configured to control simultaneous dispensing of liquid ingredients from different ingredient cartridges into the mixing container.

5. The drink vending apparatus of claim 1, wherein the control unit is configured to issue a command to initiate rinsing at least a portion of the drink vending apparatus after a drink has been provided from the drink vending apparatus.

6. The drink vending apparatus of claim 1, wherein the control unit is configured to issue a command to initiate rinsing at least a portion of the drink vending apparatus after receiving an initiate rinsing command from a remote device.

7. The drink vending apparatus of claim 1, further comprising electronic means provided with at least one ingredient cartridge for identifying contents of the at least one ingredient cartridge, wherein the electronic means comprise an electronic storage device.

8. The drink vending apparatus of claim 7, wherein the electronic means comprise an electronic tag comprising the electronic storage device and an antenna, and wherein the control unit is configured to communicate with the electronic tag, read information stored on the electronic tag, and cause information to be written to the electronic tag in response to a user command.

9. The drink vending apparatus of claim 1, further comprising electronic means provided with at least one ingredient cartridge for identifying contents of the at least one ingredient cartridge, wherein the electronic means comprise an electronic tag comprising an electronic storage device and an antenna;

wherein the electronic tag is configured to receive communications from a user employing a remote device;

wherein the electronic tag is further configured to transmit information stored on the electronic tag to the remote device and have information transmitted by the electronic device written thereon.

10. An apparatus comprising:

a plurality of ingredient cartridge slots configured to receive a corresponding plurality of ingredient cartridges;

a mixing container configured to receive liquids from all ingredient cartridges;

a control unit configured to:

selectively control dispensing of ingredients from each ingredient cartridge into the mixing container via the connection hardware; and dispense mixed ingredients from the mixing container into a receptacle in response to a drink request;

a plurality of two-port valves, each two-port valve provided with one ingredient cartridge slot; and a plurality of fluid passageways comprising a series of first fluid passageways each connecting a first opening of each of the plurality of two-port valves with a cleaning solution container and a series of second fluid passageways connecting a second opening of each of the plurality of two-port valves with the mixing container;

wherein the control unit is further configured to cause the cleaning solution container to disperse cleaning solution through the first series of passageways, through each two-port valve, and subsequently through the second series of passageways to the mixing container, thereby flushing the first series of fluid passageways, each two-port valve, and the second series of fluid passageways.

11. The apparatus of claim 10, wherein the mixing container includes one or more fittings through which different ingredients can be introduced into the mixing container from respective ingredient cartridges, and an outlet whereby the mixed ingredients exit the mixing container.

12. The apparatus of claim 10, further comprising electronic means for identifying contents provided with at least one ingredient cartridge, wherein the electronic means for identifying contents comprise an electronic storage device, wherein the control unit is configured to identify contents of one ingredient cartridge based on information available on the electronic storage device.

13. The apparatus of claim 10, further comprising electronic means for identifying contents provided with at least one ingredient cartridge, wherein the electronic means for identifying contents comprise an electronic tag comprising an electronic storage device and an antenna, and wherein the control unit is configured to communicate with the electronic tag, read information stored on the electronic tag, and cause information to be written to the electronic tag in response to a user command.

14. The apparatus of claim 10, wherein one ingredient cartridge slot is located inside an exterior of a housing forming an outer surface of the apparatus and at least one ingredient cartridge slot is formed on the exterior of the housing.

15. An apparatus comprising:

a plurality of ingredient cartridge slots configured to receive a corresponding plurality of ingredient cartridges;

a mixing container configured to receive liquids from all ingredient cartridges;

a control unit configured to receive at least one command comprising a drink request, selectively control dispensing of ingredients from each ingredient cartridge into the mixing container in proportions based on and in accordance with the drink request, and dispense mixed ingredients from the mixing container;

a plurality of two-port valves, each two-port valve provided with one ingredient cartridge slot; and a plurality of fluid passageways comprising a series of first fluid passageways each connecting a first opening of each of the plurality of two-port valves with a cleaning solution container and a series of second fluid passageways connecting a second opening of each of the plurality of two-port valves with the mixing container;

wherein the control unit is further configured to cause the cleaning solution container to disperse cleaning solution through the first series of passageways, through each two-port valve, and subsequently through the second series of passageways to the mixing container, thereby flushing the first series of fluid passageways, each two-port valve, and the second series of fluid passageways.

16. The apparatus of claim 15, wherein each ingredient cartridge comprises electronic means for identifying one ingredient contained therein.

17. The apparatus of claim 15, further comprising a waste container;

wherein the control unit is configured to:

dispense cleaning solution from the cleaning solution container into the mixing container; and expel contents of the mixing container into the waste container via an outlet.

18. The apparatus of claim 15, wherein the mixing container includes one or more fittings through which different ingredients can be introduced into the mixing container from respective ingredient cartridges, and an outlet whereby the mixed ingredients exit the mixing container.

19. The apparatus of claim 15, further comprising electronic means for identifying contents provided in at least one ingredient cartridge.

20. The apparatus of claim 19, wherein the electronic means for identifying contents comprise an electronic storage device, wherein the control unit is configured to identify contents of one ingredient cartridge based on information available on the electronic storage device.

* * * * *